US006106105A

United States Patent [19]

Mitsuhashi

[11] Patent Number: 6,106,105

[45] Date of Patent: Aug. 22, 2000

[54] RECORDING APPARATUS HAVING A MENISCUS FORMING AREA AND METHOD OF MANUFACTURING SAME

[75] Inventor: Hiroyuki Mitsuhashi, Kanagawa, Japan

[73] Assignee: Sony Corporation, Tokyo, Japan

[21] Appl. No.: 09/262,113

[22] Filed: Mar. 4, 1999

[30] Foreign Application Priority Data

Mar. 13, 1998 [JP] Japan ..... 10-063629

[51] Int. Cl.[7] ..... B41J 2/05

[52] U.S. Cl. ..... 347/65; 347/67

[58] Field of Search ..... 347/54, 56, 63, 347/65, 67, 47, 44, 46

[56] References Cited

U.S. PATENT DOCUMENTS

| | | | |
|---|---|---|---|
| 4,558,333 | 12/1985 | Sugitani et al. | 347/47 |
| 5,204,689 | 4/1993 | Shirato et al. | 347/56 |
| 5,455,998 | 10/1995 | Miyazono et al. | 347/47 |

*Primary Examiner*—John Barlow
*Assistant Examiner*—Juanita Stephens
*Attorney, Agent, or Firm*—Hill & Simpson

[57] ABSTRACT

Disclosed are a recording apparatus capable of forming such a meniscus of a dye as to allow the dye to be supplied to a dye flying portion without interruption and to be held in the dye flying portion in an amount necessary for flying of the dye, and a method of manufacturing the recording apparatus without complicating the manufacturing steps as compared with those of the related art manufacturing method. The recording apparatus includes a dye flying portion, disposed opposite to a body to be recorded, for flying, to the body to be recorded, a dye which has been supplied to the dye flying portion by way of a dye supply passage formed by partition walls; and a separately finished meniscus forming means, the means being mounted such that the leading end of the means is located at a position overlapped with the edges, on the dye flying portion side, of the partition walls or located at a position closer to the dye flying portion than the edges of the partition walls; wherein a meniscus of the dye is formed at least between the edges of the partition walls and the dye flying portion.

18 Claims, 31 Drawing Sheets

RECORDING APPARATUS HAVING A MENISCUS FORMING AREA AND METHOD OF MANUFACTURING SAME

RELATED APPLICATION DATA

The present application claims priority to Japanese Application No. P10-063629 filed Mar. 13, 1998 which application is incorporated herein by reference to the extent permitted by law.

BACKGROUND OF THE INVENTION

The present invention relates to a printer head or printer of a so-called dye vaporization-thermal transfer type in which ink is vaporized or ablated to be transferred to a body to be recorded such as a printer paper sheet, and a method of manufacturing the recording apparatus.

In recent years, printers capable of outputting a full color image with a high quality have been increasingly required, particularly, for outputting a color image processed by a personal computer or an image recorded in a video camera or electronic still camera.

Examples of already-proposed color printers include a sublimation-thermal transfer type (or dye diffusion-thermal transfer type), fusion-thermal transfer type, ink jet type, electrophotography type, and thermally processed silver salt type. Among them, the dye diffusion-thermal transfer type and ink jet type are widely known as types capable of readily outputting a high quality image with a relatively simple apparatus.

The dye diffusion-thermal transfer type uses an ink ribbon or sheet coated with an ink layer formed by diffusing a transfer dye in a suitable binder resin at a high concentration. The ink ribbon or sheet is brought in close contact, at a specific pressure, with a so-called thermal transfer paper sheet coated with a dyeing resin capable of receiving the transferred dye. Then, the ink ribbon or sheet is given a thermal energy by a thermal head placed on the ink ribbon or sheet, with a result that the transfer dye is thermally transferred from the ink ribbon or sheet onto the thermal transfer paper sheet in accordance with the given thermal energy.

The above operation is repeated for each of the image signals associated with subtractive three primaries, yellow (Y), magenta (M), and cyan (C) separated from one color image, to thereby obtain a full color image having a continuous gradation.

FIG. 41 shows the configuration of a peripheral portion of a thermal head of a printer of this type.

A thermal head 70 is disposed opposite to a platen roller 71, between which an ink sheet 72 and a thermal transfer paper sheet 73 run by the rotating platen roller 71 in a state being pressed on the thermal head 70. The ink sheet 72 includes a base film 72*b* on which an ink layer 72*a* is provided, and the thermal transfer paper sheet 73 includes a paper sheet 73*b* whose surface is coated with a dyeing resin layer (dye receiving layer) 73*a*.

The ink in the ink layer 72*a* selectively heated by the thermal head 70 in accordance with an image to be printed is thermally diffused in the dyeing resin layer 73*a* of the thermal transfer paper sheet 73 heated in contact with the ink layer 72*a*. In this way, thermal transfer, for example, in a dot pattern is performed.

This dye diffusion-thermal transfer type is advantageous in miniaturizing the printer, making easy the maintenance of the printer, and enhancing the instancy of the printer, and further obtaining a high quality image comparable to that obtained by silver salt color photograph. The type, however, is disadvantageous in causing a large amount of waste products resulting from throwaway of the ink ribbon or sheet and in raising the running cost. Also since this type is required to use thermal transfer paper sheets, it presents a problem in further raising the cost.

The fusion-thermal transfer type enables transfer to normal paper sheets; however, since the type uses an ink ribbon or sheet, it is disadvantageous in causing a larger amount of waste products resulting from throwaway of the ink ribbon or sheet and in raising the running cost. Also the image quality obtained by this type is inferior to that obtained by silver salt photograph.

The thermally processed silver salt type is capable of obtaining a high image quality; however, since the type uses specialized photographic paper sheets and a throwaway type ribbon or sheet, it is disadvantageous in raising the running cost. Also this type has another problem in raising the apparatus cost.

The ink jet type is, as disclosed in Japanese Patent Publication Nos. Sho 61-59911 and Hei 5-217, classified into an electrostatic attraction type, continuous vibration generating type (piezo type), and a thermal type (bubble jet type). In this ink jet type, the printing is performed by jetting droplets of ink from a nozzle provided on a printer head to stick them to a printer paper sheet or the like.

The ink jet type, accordingly, is advantageous in lowering the running cost because it enables transfer to normal paper sheets and it does not use any ink ribbon or the like, and in substantially eliminating occurrence of waste products unlike the type using an ink ribbon or the like. The ink jet type, however, is disadvantageous in making it in principle difficult to obtain the density gradation in pixels, and hence to reproduce a high quality image comparable to that obtained by silver salt photograph for a short time unlike the above-described dye diffusion-thermal transfer type.

The electrophotographic type is advantageous in lowering the running cost and increasing the transfer speed; however, it is disadvantageous in making it difficult to obtain an image quality comparable to that obtained by silver salt photograph and in significantly raising the apparatus cost.

In summary, it becomes apparent that either of the above-described types fails to satisfy all requirements in terms of image quality, running cost, apparatus cost, transfer time, and the like.

Under such circumstances, as a color printer type capable of satisfying all the requirements, a so-called dye vaporization-thermal transfer type has been proposed, for example, in Japanese Patent Laid-open Nos. Hei 7-89107 and Hei 7-89108.

In this type, transfer operation is performed by heating ink on a transfer portion of a printer head to fly the ink by vaporization or ablation, and sticking the vaporized or ablated ink onto the surface of an object to be transferred such as a printer paper sheet disposed opposite to the transfer portion with a gap of about 50 to 100 $\mu$m put therebetween.

The transfer portion includes an irregular ink holding structure in which a large number of pillars, each having the width or radius of about 2 $\mu$m and the height of about 6 $\mu$m, are erected with micro-intervals of about 2 $\mu$m put therebetween. Also a heater is provided under the ink holding structure, to constitute a vaporizing portion.

The provision of such an ink holding structure exhibits the following effects:

(1) The ink is spontaneously supplied to the vaporizing portion by the capillary phenomenon;

(2) The ink can be efficiently heated via a large surface area;

(3) The ink in a specific amount can be usually held in the vaporizing portion by suitably setting the heights of the pillars; and (4) Since the surface tension of liquid generally has a negative temperature coefficient, the locally heated ink is applied with a force allowing the ink to flow to the outer peripheral portion kept at a low temperature; however, the movement of the ink toward the outer peripheral portion is suppressed at minimum by the ink holding structure, to thereby prevent lowering of the transfer sensitivity.

The provision of such an ink holding structure, accordingly, makes it possible to vaporize or ablate ink in an amount corresponding to the heating energy generated at the vaporizing portion and transfer the ink to a printer paper sheet or the like, and hence to attain continuous control of the transferred amount of the ink, that is, density gradation in pixels. As a result, the dye vaporization-thermal transfer type having the ink holding structure is capable of obtaining a high quality image comparable to that obtained by silver salt color photograph.

Since this type is not required to use any ink ribbon or the like, it is low in running cost, and since this type enables transfer to normal paper sheets by using ink having a high absorbing property for the normal paper sheets, it allows the reduction in the cost by use of normal paper sheets.

Since this type makes use of vaporization or ablation of ink (that is, a dye), it is not required not only to press the transfer portion of the printer head for heating the ink to an object to be transferred such as a printer paper sheet at a high pressure, but also to bring the transfer portion in contact with the object to be transferred. As a result, this type is advantageous in eliminating thermal fusion between an ink heating portion such as an ink ribbon and a printer paper sheet, which fusion has been often caused in other thermal transfer types.

As described above, in this recording head, dots are formed by fixing a dye on a body to be recorded, and accordingly, an interval between the two adjacent ones of the dye flying portions (heating or transfer portions) constitutes one dot interval. In other words, one dye flying portion is equivalent to one dot, and the dot intervals exert an effect on the resolution of a printed image. To be more specific, as the dot intervals become narrower, a higher resolution can be obtained.

From this viewpoint, one means for increasing the resolution is to make narrower each interval (dot interval) between the two adjacent ones of the dye flying portions; however, in the above-described recording head, a dye is supplied to one dye flying portion through one dye supply passage, and accordingly, if each interval between the two adjacent ones of the dye flying portions is made narrower for attaining an image with a high resolution; each interval between the two adjacent ones of the dye supply passages must be made narrower.

In other words, it is difficult to make narrower the above dot intervals unless the cross-sections of the dye supply passages are reduced. The reduction in cross-section of the dye supply passages, however, makes narrower the dye supply passages. This could lead to the possibility that the dye in an amount necessary and sufficient for transfer may not be supplied to the dye flying portions, and other problems that may make the method of manufacturing the head including the dye supply portions complicated and that its manufacturing yield reduced and its cost raised due to needs for the required enhancement of printer performance.

The present applicant has already proposed a recording apparatus capable of solving the above-described problems while making use of the advantages of the above-described dye flying structure in Japanese Patent Laid-open Nos. Hei 7-354113, 7-354114, and 7354115.

The common point, in the previously proposed recording apparatuses, for solving the above-described problems lies in that a recording head having dye flying portions for flying a dye to a body to be recorded is in contact with the body to be recorded in such a manner as to be tilted relative to the body to be recorded and in such a state, each dye flying portion is separated from the body to be recorded with a specific gap kept therebetween, and that branched passages branched from a common dye supply passage for supplying the dye are formed in order to simultaneously supply the dye from respective branched passages to a plurality of the dye flying portions.

FIG. 42 is a plan view showing an essential portion of the above-described recording head 20. In the recording head 20, a printed board 28 and a head chip 31 are bonded by means of a silicon based adhesive on an aluminum base 25 serving as a heat sink, and a cover 32 shown in FIG. 43 is mounted on the printed board 28 and the head chip 31 and bonded thereto by means of the same adhesive.

FIG. 44 is a sectional view of the above recording head 20. A portion, adapted to mount the printed board 28, of the base 25 is thinned by a thickness equivalent to that of the printed board 28, and the printed board 28 is mounted on the mounting portion of the base 25. In this mounting state, the total of the height of the printed board 28 and the height of a driver IC 26, for driving heaters, mounted on the printed board 28 is substantially equal to the height of the top surface of the head chip 31 mounted in parallel to the printed board 28.

The portion, on which the head chip 31 is adhesively bonded, of the base 25 has two grooves 33 for allowing the head chip 31 to be uniformly bonded on the base 25. To be more specific, an excess of the adhesive used for bonding the head chip 31 is escaped in the grooves 33. As shown in FIGS. 42 and 44, a connection portion between electrodes provided on the head chip 31 and the driver IC 26, and a connection portion between the driver IC and wiring provided on the printed board 28 are coated with a silicone resin based coating material JCR (junction coating resin) 27, which coating material is then thermally cured, in order to protect bonding wires for connection.

The printed board 28 has, as shown in FIGS. 42 and 44, a dye introducing hole 29 which passes through the base 25. A liquid dye 7 is introduced from the base 25 side between the cover 32 and the base 25 through the dye introducing hole 29. The cover 32 is adhesively bonded on the printed board 28 and the head chip 31 in such a manner as to sealingly cover a part of the printed board 28 and a part of the head chip 31. The inner surface portion of the cover 32 forms a common dye supply passage for receiving the dye 7 introduced through the dye introducing hole 29 and supplying the dye 7 into the above-described branched passages.

The recording head 20 is, as shown in FIG. 44, configured such that one end 25*a*, on the side on which the head chip 31 is provided, of the base 25 is brought in contact with a body 34 to be recorded while being tilted at a specific angle with respect to the body 34 to be recorded, so that as shown in FIG. 45, an interval between the center $C_1$ of each dye flying portion 6 and the body 34 to be recorded can be kept constant.

In FIG. 44, the solid line arrow S designates the scanning direction of the recording head 20 upon printing, and the broken line arrow S' designates the return direction after printing. Accordingly, upon printing, the heaters are heated in accordance with a signal corresponding to image data supplied by way of a connector 30 provided at the leading end portion of the printed board 28, to vaporize the dye 7 from each dye flying portion 6, thereby flying the dye to the body 34 to be recorded. The wiring on the printed board 28 is connected to a FPC (flexible print circuit, not shown) through the connector 30. The apparatus is driven in accordance with a serial mode shown in FIG. 46 or a line mode shown in FIG. 47.

In the serial mode, as shown in FIG. 46, three pieces of dye storing portions 24, which store dyes of three primaries, Y (yellow), M (magenta) and C (cyan) (may be further added with black), are mounted three pieces of the recording heads 30 disposed in parallel to each other, respectively. These recording heads 20 are connected to respective movable pieces 23 engaged with a feed shaft 21 via respective connecting members 22. Since the feed shaft 21 is screw-engaged with the movable pieces 23, each recording head 20 is reciprocated in the direction shown by the arrow Y by turning of the feed shaft 21 driven by a drive source (not shown).

Meanwhile, the body 34 to be recorded, which is disposed opposite to the recording heads 20, is moved in the direction shown by the arrow X by feed rollers 18 for each line scanning of the recording heads 20. Accordingly, the body 34 to be recorded, which is positioned between a platen 19 and the recording heads 20, is printed by the recording heads 20.

In the line mode, as shown in FIG. 47, recording heads 20A, each having a length equivalent to the width of the body 34 to be recorded, are longitudinally disposed in the X-direction. These recording heads 20A are similarly mounted with dye storing baths 24A which store dyes of three primaries, Y (yellow), M (magenta), and C (cyan) (which may be further added with black).

The body 34 to be recorded, which is disposed opposite to the recording heads 20A and positioned between the recording heads 20A and the platen 19, is printed by the recording heads 20A, and after specific printing, the body 34 to be recorded is moved in the X-direction by rollers 18. In this way, the printing is subsequently performed.

FIG. 48 is a plan view showing part of the head chip 31 of the above-described recording head. The dye 7 introduced between the cover 32 and the base 25 as shown in FIG. 44 is supplied, by the capillary phenomenon, through a capillary region 36*a* in which the branched passages are formed by a base plate 1, partition walls 2 and a lid 3B, and is then supplied to the dye flying portions 6 by way of a between-partition wall region 36*b* and a communication region 36*c*.

As shown in FIG. 48, the partition walls 2 forming branched passages 8 project to the vicinity of intermediate portions between the lid 3B and the dye flying portions 6. The remaining half ranging from the intermediate portions to the dye flying portions 6, in which the partition walls 2 are not present, forms the communication region 36*c*. In the communication region 36*c*, the dye 7 passing through one branched passage 8 can be not only supplied linearly to the normal dye supply region to which the dye 7 should be mainly supplied by way of the branched passage 8 but also supplied curvedly to the two dye flying portions 6 on the adjacent branched passage sides as shown by the arrows.

FIG. 49 is a sectional view taken on line XXXXIX—XXXXIX of FIG. 48. In the capillary region 36*a*, since the dye 7 is stably supplied by the capillary phenomenon, there little occurs a fear of lacking of supply of the dye 7; however, in the between-partition wall region 36*b* and particularly in the communication region 36*c*, a meniscus 7*a* is formed as shown in FIG. 50. At the meniscus 7*a*, the thickness of the dye 7 becomes thin. The occurrence of the meniscus 7*a* causes an inconvenience that the supply of the dye 7 does not catch up with the flying of the dye 7 from each dye flying portion 6. Consequently, as shown in FIG. 51, a dye disappearance portion 37 occurs, which may cause interruption of the dye 7 in the course of the flow of the dye 7. It should be noted that in FIG. 51, the dye in the region equivalent to one dot is represented as points for an easy understanding.

If there occurs the interruption of the dye 7, such interruption is difficult to be recovered, which obstructs the supply of the dye 7 to the dye flying portions. As a result, the dye 7 in the dye flying portions 6 are gradually lost, making impossible the flying of the dye 7 in accordance with image information.

Also since the partition wall 2 is formed of a sheet-like organic matter by lithography, the shape of the partition wall 2 is not stabilized; the surface state of the partition wall 2 may be finely changed; and/or the distance between the edge 2*a* of the partition wall 2 and the dye flying portion 6 may be changed, with a result that the meniscus of the surface of the dye 7 may be changed, failing to obtain a specific height of the dye on the dye flying portion 6. That is to say, it becomes apparent that the above-described related art recording head has room for improvement.

SUMMARY OF THE INVENTION

An object of the present invention is to provide a recording apparatus capable of forming such a meniscus of a recording material as to allow the recording material to be supplied to a recording material flying portion without interruption and to be held in the recording material flying portion in an amount sufficient for flying of the recording material, and to provide a method of manufacturing the recording apparatus without complicating the manufacturing steps as compared with those of the related art manufacturing method.

To achieve the above object, according to a first aspect of the present invention, there is provided a recording apparatus including: a recording material flying portion, disposed opposite to a body to be recorded, for flying, to the body to be recorded, a recording material which has been supplied to the recording material flying portion by way of a recording material supply passage formed by partition walls; and a separately finished meniscus forming means, the means being mounted such that the leading end of the means is located at a position overlapped with the edges, on the recording material flying portion side, of the partition walls or located at a position closer to the recording material flying portion than the edges of the partition walls; wherein a meniscus of the recording material is formed at least between the edges of the partition walls and the recording material flying portion.

With this recording apparatus, the leading end of the meniscus forming means, which is separately finished and is then mounted, is located at a position closer to the recording material flying portion than the edges, on the recording material flying portion side, of the partition walls, so that a meniscus of the recording material is formed between the leading end of the meniscus forming means and the recording material flying portion. This makes it possible to form such a meniscus of the recording material as to allow the recording material to be supplied to the recording material flying portion without interruption and to be held in the recording material flying portion in an amount sufficient for flying of the recording material. As a result, the recording apparatus of the present invention allows desired recording on a body to be recorded, leading to the increased yield of products and the reduced cost. Also since the meniscus forming means is separately finished and then mounted, it can be mounted with its shape and surface state kept stable without occurrence of the above-described problem associated with the post-processing such as photolithography, and more specifically, it keeps the distance between the recording material flying portion and the meniscus forming means, to usually keep constant the state of the meniscus (that is, keep constant the height of the recording material), thereby contributing to desired recording.

According to a second aspect of the present invention, there is provided a method of manufacturing a recording apparatus having a recording material flying portion, disposed opposite to a body to be recorded, for flying, to the body to be recorded, a recording material which has been supplied to the recording material flying portion by way of a recording material supply passage formed by partition walls, the method including the steps of: forming the partition walls; separately finishing a meniscus forming means into a shape having the leading end which is located at a position overlapped with the edges, on the recording material flying portion, of the partition walls or located at a position closer to the recording material flying portion than the edges of the partition walls; and mounting the meniscus forming means in such a manner as to form a meniscus of the recording material at least between the edges of the partition walls and the recording material flying portion.

With this manufacturing method, it is possible to manufacture the above-described recording apparatus with a good repeatability.

In the present invention, the wording "partition wall" means a side wall of the recording material supply passage, and it does not contain a lid (to be described later) forming the meniscus forming means. The wording "flying" means the flying of a recording material by vaporization, evaporation, ablation or capillary wave (transfer of ink in mist by making use of the collision force of the ink due to surface tension convection (Marangoni flow) of the ink caused by thermal energy generated from a heater).

In the recording apparatus and the manufacturing method thereof according to the present invention, preferably, the partition walls, which serve as side walls of the recording material supply passage, form the recording material supply passage in combination with a lid mounted on the side walls; and the lid, which functions as the meniscus forming means, extends to the vicinity of the recording material flying portion.

In addition to the lid, a separately finished second meniscus forming means may be mounted opposite to the lid with the recording material flying portion put therebetween; and the second meniscus forming means may form a meniscus of the recording material between the recording material flying portion and the second meniscus forming means.

The lid may extend to a region containing the upper side of the recording material flying portion, and it has an opening portion over the recording material flying portion.

The meniscus forming means may be separately finished and stuck between the edges of the partition walls and the recording material flying portion.

The partition walls for forming the recording material supply passage may be separately finished to be extended such that the leading ends of the extended portions of the partition walls are located at positions closer to the recording material flying portion than the edges of the partition walls excluding the extended portions, and the partition walls having the extended portions may be mounted as the meniscus forming means.

The recording material flying portion preferably has irregularities composed of, for example, small pillars for holding the recording material.

Preferably, branched passages, which are branched from a common recording material supply passage and adapted to supply the recording material to the recording material flying portion, are provided as the recording material supply passage by the partition walls. The recording material supply passage is not limited to the common supply passage.

The recording material is preferably flied, by heating using a heater, to the body to be recorded which is disposed opposite to the recording material flying portion in non-contact with the recording material flying portion.

BRIEF DESCRIPTION OF THE DRAWINGS

FIGS. 7A and 7B show the head chip shown in FIG. 6, wherein FIG. 7A is a schematic sectional view taken on line VIIa—VIIa of FIG. 6; and FIG. 7B is a schematic sectional view taken on line VIIb—VIIb of FIG. 6;

FIGS. 9A and 9B show a head chip according to a third embodiment, wherein FIG. 9A is a schematic plan view showing part of the head chip, and FIG. 9B is a schematic sectional view taken on line IX—IX of FIG. 9A;

FIGS. 13A and 13B show cross-sections of the head chip shown in FIG. 12, wherein FIG. 13A is a schematic sectional view taken on line XIIIa—XIIIa of FIG. 12, and FIG. 13B is a schematic sectional view taken on line XIIIb—XIIIb of FIG. 12;

DETAILED DESCRIPTION OF THE PREFERRED EMBODIMENTS

Hereinafter, preferred embodiments of the present invention will be described with reference to the accompanying drawings.

First Embodiment

Figure 1:
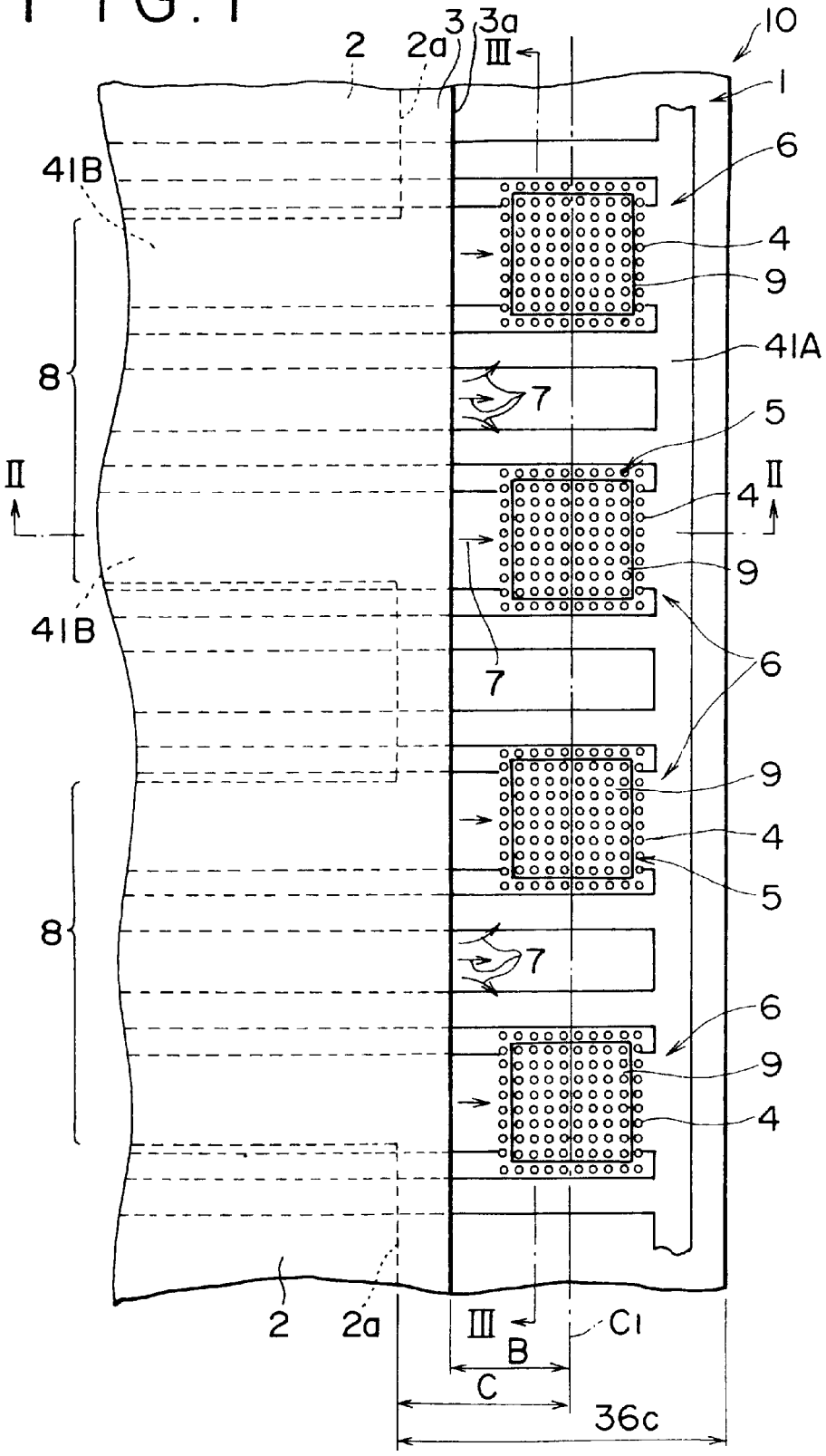
FIG. 1 is a schematic plan view showing part of a head chip according to a first embodiment.
Figure 2:
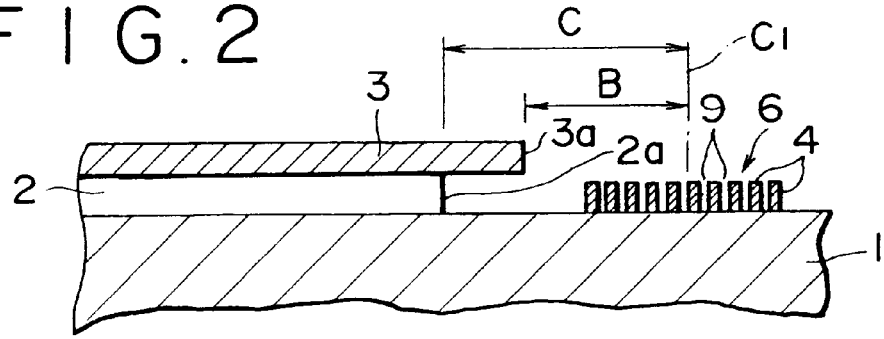
FIG. 2 is a schematic sectional view taken on line II—II of FIG. 1.
Figure 3:
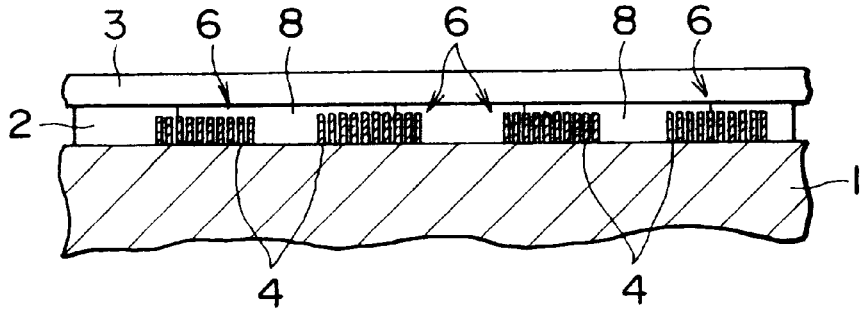
FIG. 3 is a schematic reduced sectional view taken on line III—III of FIG. 1.

FIG. 1 is a plan view showing part of a head chip 10 according to a first embodiment; FIG. 2 is a sectional view taken on line II—II of FIG. 1; and FIG. 3 is a reduced sectional view taken on line III—III of FIG. 1. In this embodiment, parts common to those described in the above-described related art are designated by the common characters. The same is true for other embodiments to be described later.

Figure 44:
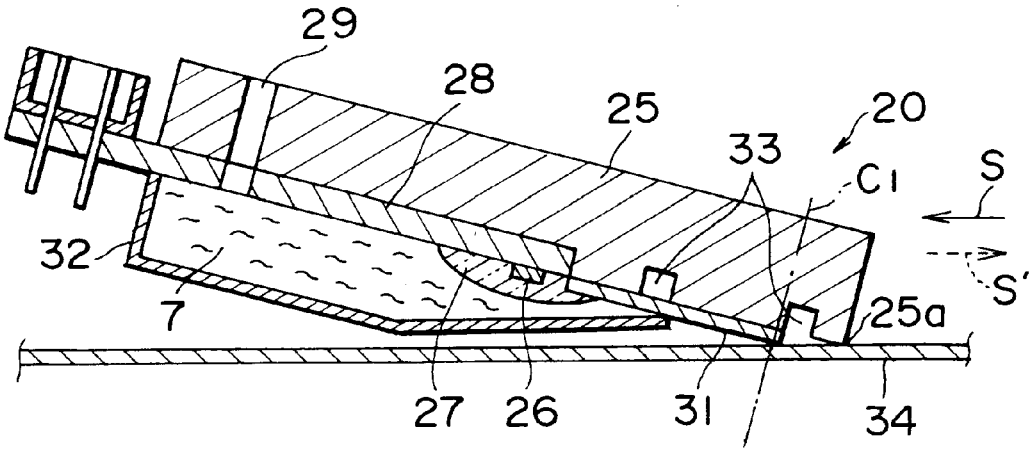
FIG. 44 is a schematic sectional view showing the recording state by the printer head shown in FIG. 42.
Figure 45:
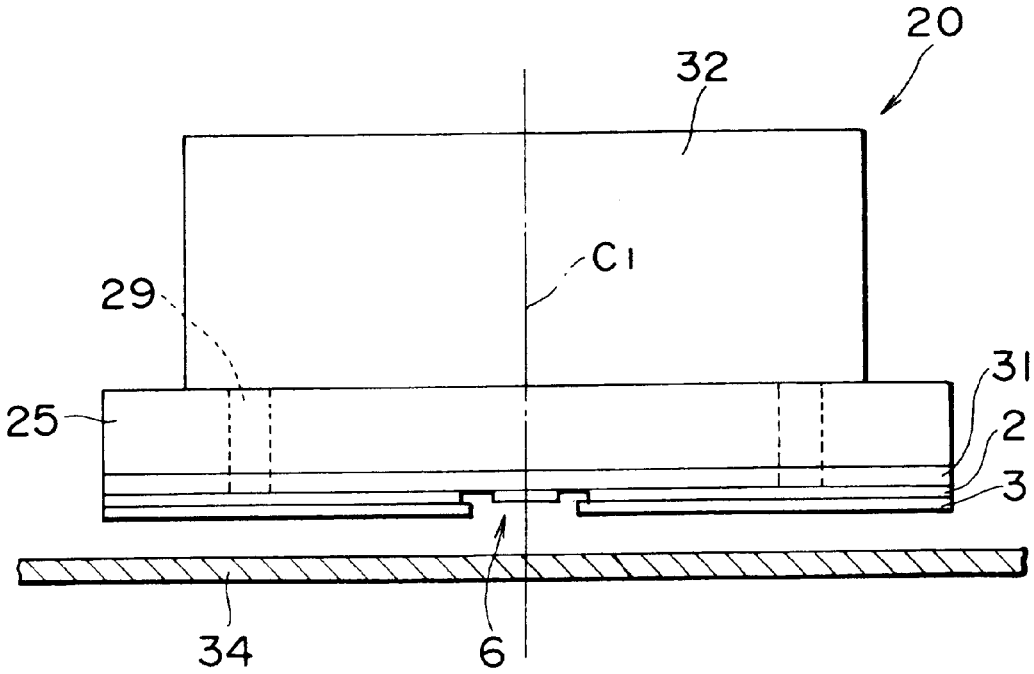
FIG. 45 is a schematic side view showing the recording state by the printer head shown in FIG. 42.

As shown in FIGS. 2 and 3, in the head chip 10 in this embodiment, partition walls 2 and a lid 3 are formed on a base plate 1, to form branched passages 8 branched from the same common dye supply passage as that shown in FIG. 44. The base plate 1 is made from Si (silicon) and has a thickness of 5 mm or less, for example, 0.2 to 1 mm. The partition wall 2 is formed of a dry film (for example, sheet resist) having a thickness of 50 $\mu$m or less, for example, 10 to 30 $\mu$m. The lid 3 is formed of a Ni (nickel) sheet having a thickness of 100 $\mu$m or less, for example, 20 to 30 $\mu$m, which lid is separately, accurately finished (the same is true for the other embodiments to be described later). Such a configuration is commonly applied to the other embodiments to be described later.

Dye flying portions 6, each of which forms one dot, are provided at the leading end portion of the base plate 1. The dye flying portion 6 includes a group of fine pillars 4, each having a width or radius of 10 $\mu$m or less (for example 1 to 4 $\mu$m) and a height of 20 $\mu$m or less (for example 1 to 10 $\mu$m), arranged at intervals of 10 $\mu$m or less (for example 1 to 4 $\mu$m); a heater (not shown) made from, for example poly-Si (polysilicon) for heating the dye 7 and flying it; and an electrode (not shown) made from, for example, Al (aluminum) for carrying a current to the heater. Such a configuration is commonly applied to the other embodiments to be described later.

As shown in FIG. 2, the lid 3 is disposed at a position satisfying a relationship in which the distance B between an edge 3*a*, on the side near each dye flying portion 6, of the lid 3 and the center line C, of the dye flying portion is in a range of 15 $\mu$m or more (for example, 30 to 100 $\mu$m), and each partition wall 2 for forming the branched passage 8 is disposed at a position satisfying a relationship in which the distance C between an edge 2*a*, on the side near each dye flying portion 6, of the partition wall 2 and the center line $C_1$ of the dye flying portion 6 is equal to or more than the distance B ($C \geqq B$). In this way, a means for forming the meniscus of the dye 7 can be formed without complicating the manufacturing steps. The above positional relationship preferably satisfies $C>B$, more preferably satisfies $(1/2)C \geqq B \geqq (1/5)C$.

As shown in FIG. 1, the dye 7 supplied by way of the branched passages 8 is naturally spread in the communication region 36*c* as shown by the arrows, and is then stored in dye storing portions 9 of the group of the small pillars 4 in the dye flying portions 6.

Figure 4:
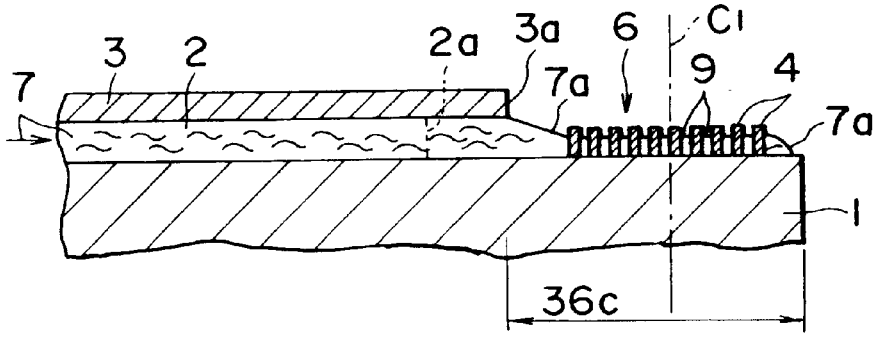
FIG. 4 is a schematic sectional view showing introduction of a dye to the portion shown in FIG. 2 and a meniscus.
Figure 5:
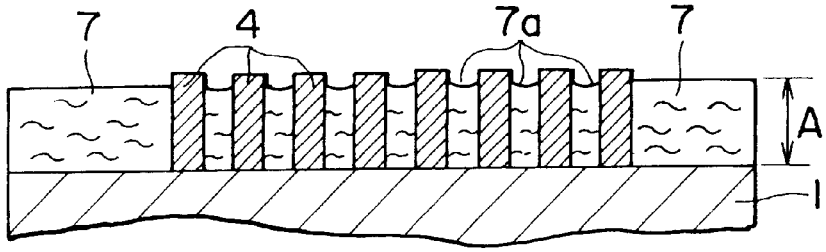
FIG. 5 is an enlarged sectional view showing the meniscus in the vicinity of a dye flying portion.

FIG. 4 is a sectional view showing the flow-in state of the dye 7 in the portion shown in FIG. 2. FIG. 5 is an enlarged sectional view of the vicinity of the dye flying portion 6 in the state shown in FIG. 4. As shown in these figures, the dye 7 supplied in the region of each branched passage 8 surrounded by the base plate 1, partition walls 2 and lid 3 by the capillary phenomenon naturally forms a meniscus 7*a* on the surface of the dye 7 in the communication region 36*c*. At the meniscus 7*a*, as shown in FIG. 5, the thickness A of the dye 7 becomes thin; however, in this embodiment, the desired thickness A of the dye 7 can be obtained by the above meniscus forming means.

That is to say, the height A of the dye 7 on the dye flying portion 6 is, as mainly shown in FIG. 4, determined by the meniscus 7*a* of the surface of the dye 7 formed in a region from the edge 3*a*, on the side near the dye flying portion 6, of the lid 3 and the dye flying portion 6, and the heights of the small pillars 4.

Accordingly, the shape of the meniscus of the surface of the dye 7 formed in the region from the edge 3*a*, on the side near the dye flying portion 6, of the lid 3 to the dye flying portion 6 is adjusted by treating the surface, in contact with the dye 7, of the lid 3 for changing the contact angle between the surface of the lid 3 and the dye 7 or adjusting the distance B between the edge 3*a*, on the side near the dye flying portion 6, of the lid 3 and the center line $C_1$ of the dye flying portion 6. This makes it possible to obtain the desired height of the dye 7.

In the recording head including the head chip 10, a current flows from the electrodes to the heaters in accordance with image information, and the dye 7 in the dye flying portions 6 is vaporized by joule heat generated from the heaters, to be thus flied to a body to be recorded (not shown) disposed opposite to the dye flying portions 6.

Figure 51:
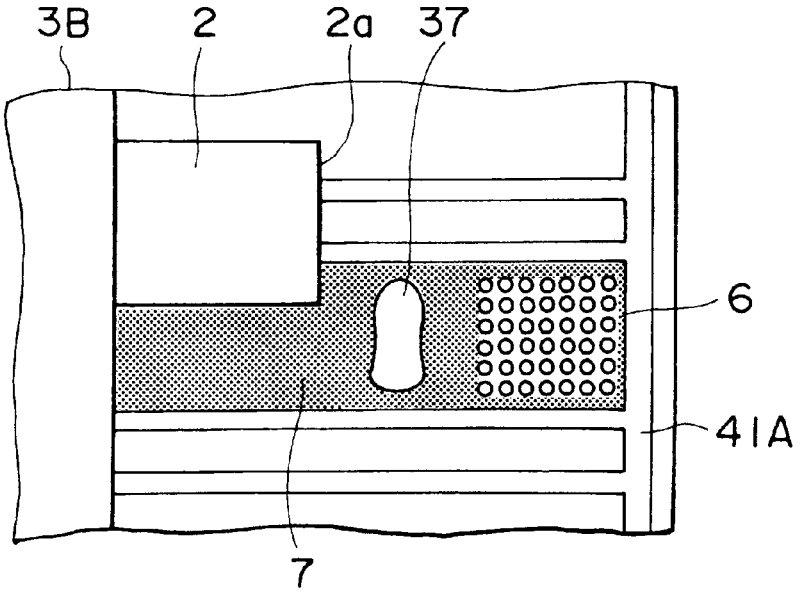
FIG. 51 is a schematic partial plan view showing a dye disappearance portion in a head chip.

If the dye flying structure composed of the small pillars 4 or the like is not provided on each dye flying portion 6, a problem occurs. For example, the dye 7 present on the dye flying portion 6 is heated by the heater to which a current has been carried from the electrode in accordance with image information, and is flied. However, at that time, the dye 7 tends to escape from the heated top surface portion of the heater due to a reduction in surface tension of the dye 7 caused by heat generation and locally exists at the outer peripheral portion of the dye flying portion 6, with a result that it is difficult to ensure the dye 7 in an amount necessary and sufficient for flying of the dye 7. On the contrary, in this embodiment, the dye flying structure composed of the small pillars 4 present on the dye flying portion 6 makes it possible to hold the dye 7 by the capillary phenomenon, and to continuously supply the dye 7 to the dye flying portion 6 in an amount necessary and sufficient for flying of the dye 7, without occurrence of the dye disappearance portion 37 shown in FIG. 51.

As described above, to fly the dye 7 in a desired amount in accordance with image information, it is required to control the amount of the dye 7 present on each dye flying portion 6. If the amount of the dye 7 present on the dye flying portion 6 is more than the desired amount, that is, if the height A of the dye 7 present on the dye flying portion 6 is higher than a desired height, an excessive energy must be given to heat the dye 7, that is, it is difficult to fly the dye 7 in the desired amount unless the excessive energy is given to the dye 7.

On the contrary, if the amount of the dye 7 present on the dye flying portion 6 is less than the desired amount, that is, the height A of the dye 7 present on the dye flying portion 6 is lower than a desired height, the dye 7 becomes little present on the dye flying portion 6 upon flying of the dye 7 resulting from the so-called "escape" phenomenon of the dye 7 from the dye flying portion 6 caused by a reduction in surface tension of the dye 7 upon heating, thereby making it impossible to fly the dye 7 in the desired amount.

As described above, the height A of the dye 7 present on the dye flying portion 6 is determined by the heights of the small pillars 4 and the meniscus of the surface of the dye 7 formed in the region between the edges, on the side near the dye flying portion 6, of the partition walls 2 and the lid 3 forming the dye supply passage and the dye flying portion 6.

In this embodiment, since the edge 3*a* of the lid 3 projects up to the position closer to the dye flying portion 6 than the edges 2*a* of the partition walls 2, it is possible to suppress the decay of the meniscus 7*a* of the dye 7. To be more specific, the formation of the meniscus having a desired shape is obstructed by the fact that the edge of each partition wall 2 formed by photolithography has fine irregularities from the microscopic view, and therefore, the shape of the edge of the partition wall 2 is not stabilized; the surface state of the partition wall 2 may be finely changed; and the distance between the edge of the partition wall 2 and the dye flying portion 6 may be changed. Accordingly, the meniscus 7*a* of the dye 7 formed in the region from the edge 3*a* of the lid 3 to the dye flying portion 6 can be formed into a desired shape by mounting the separately finished lid 3 in such a manner that the edge 3*a* of the lid 3 projects closer to the position near the dye flying portion 6 than the edges 2*a* of the partition walls 2. This makes it possible to hold the height A of the dye 7 at a desired height in the dye flying portion 6. Further, the head chip in this embodiment can be simply manufactured only by changing the sticking position of the separately finished lid 3.

Second Embodiment

Figure 6:
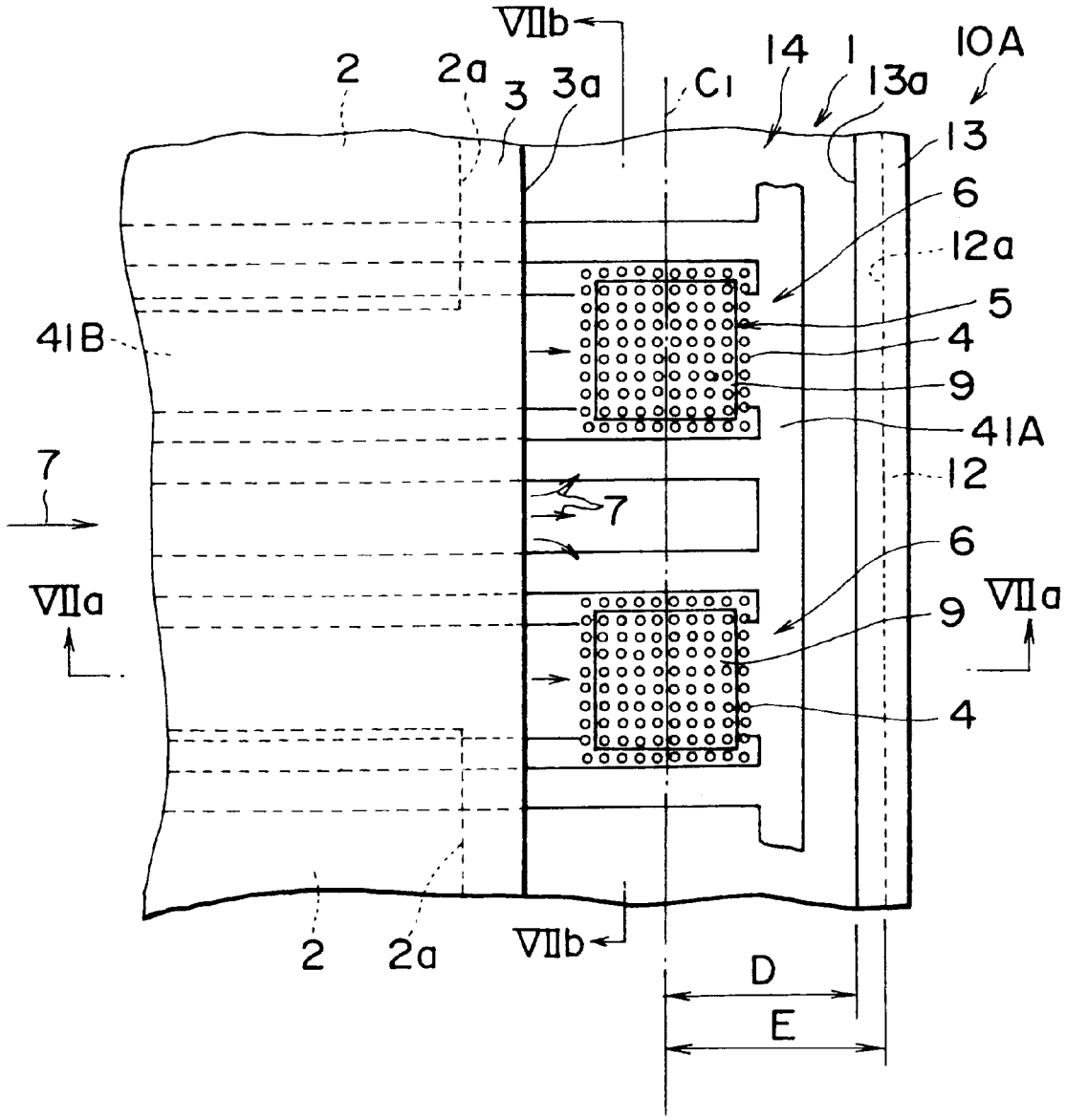
FIG. 6 is a schematic plan view showing part of a head chip according to a second embodiment.
Figure 7A:
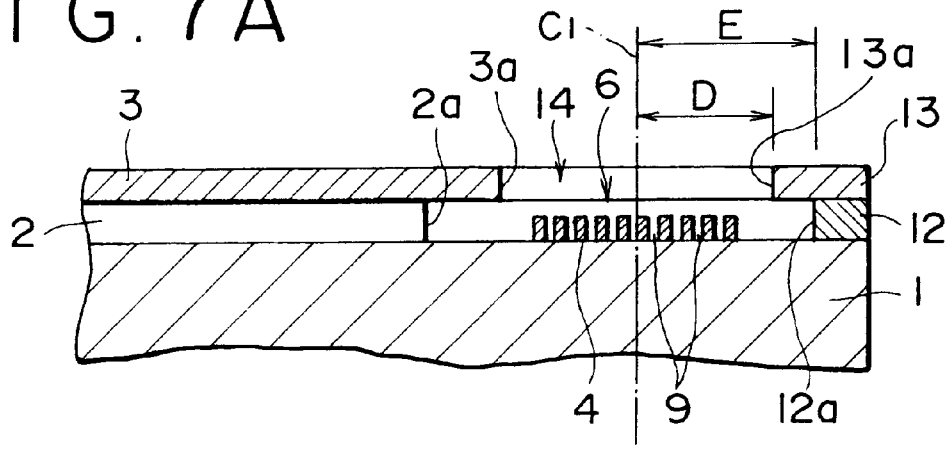

FIG. 6 is a plan view showing part of a head chip 10A according to a second embodiment; FIG. 7A is a sectional view taken on line VIIa—VIIa of FIG. 6; and FIG. 7B is a sectional view taken on line VIIb—VIIb of FIG. 6.

Figure 7B:
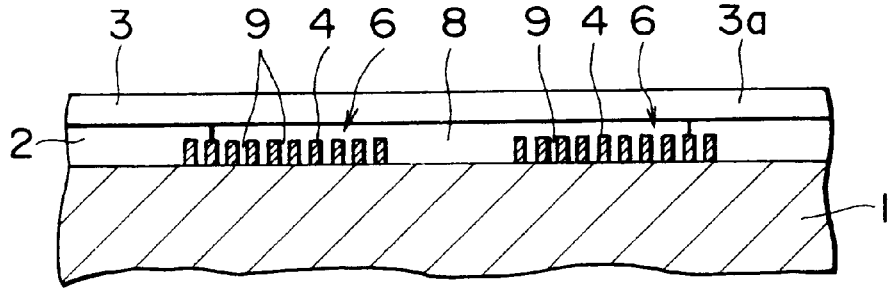

In this embodiment, as shown in FIG. 6 and FIGS. 7A and 7B, a side wall 12 and a lid 13 for covering the upper portion of the side wall 12 are provided opposite to the lid 3 in the first embodiment with respect to the dye flying portions 6, to form a slit structure over the dye flying portions 6. The head chip 10A in this embodiment, having such a configuration, can be manufactured without complicating the manufacturing steps.

As shown in FIG. 7A, the lid 13 is provided at a position satisfying a relationship in which the distance D between an edge 13*a*, on the side near the dye flying portion 6, of the lid 13 and the center line $C_1$ of the dye flying portion 6 is in a range of 15 $\mu$m or more (for example, 30 to 100 $\mu$m), and the side wall 12 is provided at a position satisfying a relationship in which the distance E between an edge 12*a*, on the side near the dye flying portion 6, of the side wall 12 and the center line $C_1$ of the dye flying portion 6 is equal to or more than the distance D ($E \geqq D$)

Figure 8:
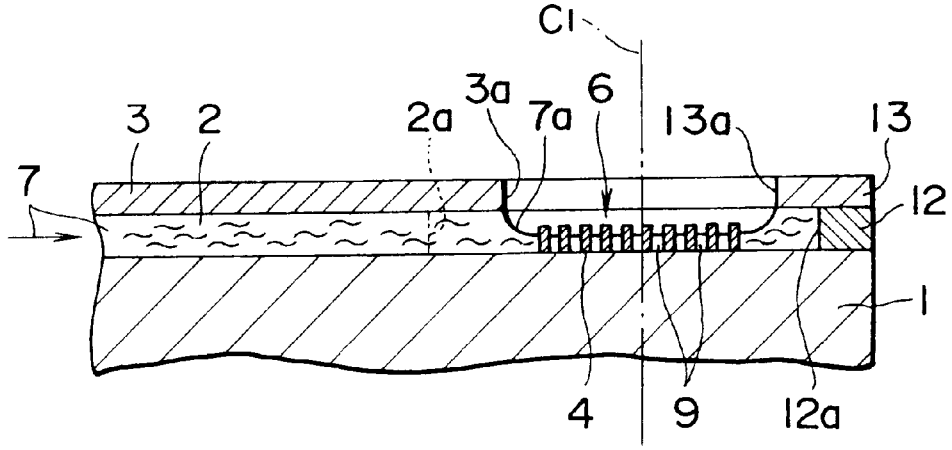
FIG. 8 is a schematic sectional view showing flowin of the dye to the portion shown in FIG. 7A and a meniscus.

Accordingly, in this embodiment, a second meniscus forming means is formed on the side opposite to the edge 3*a* of the lid 3, and as shown in FIG. 8, the meniscus 7*a* of the dye 7 is formed from both the sides of a slit 14 by combination of the first meniscus forming means described in the first embodiment and the second meniscus forming means, to thereby hold the height A of the dye 6 shown in FIG. 5 at a more desired height.

According to this embodiment, in addition to the effect obtained by the first embodiment, there can be obtained an effect of capable of forming a more desired shape of the meniscus 7*a* of the dye 7 by provision of the second meniscus forming means.

Third Embodiment

Figure 9A:
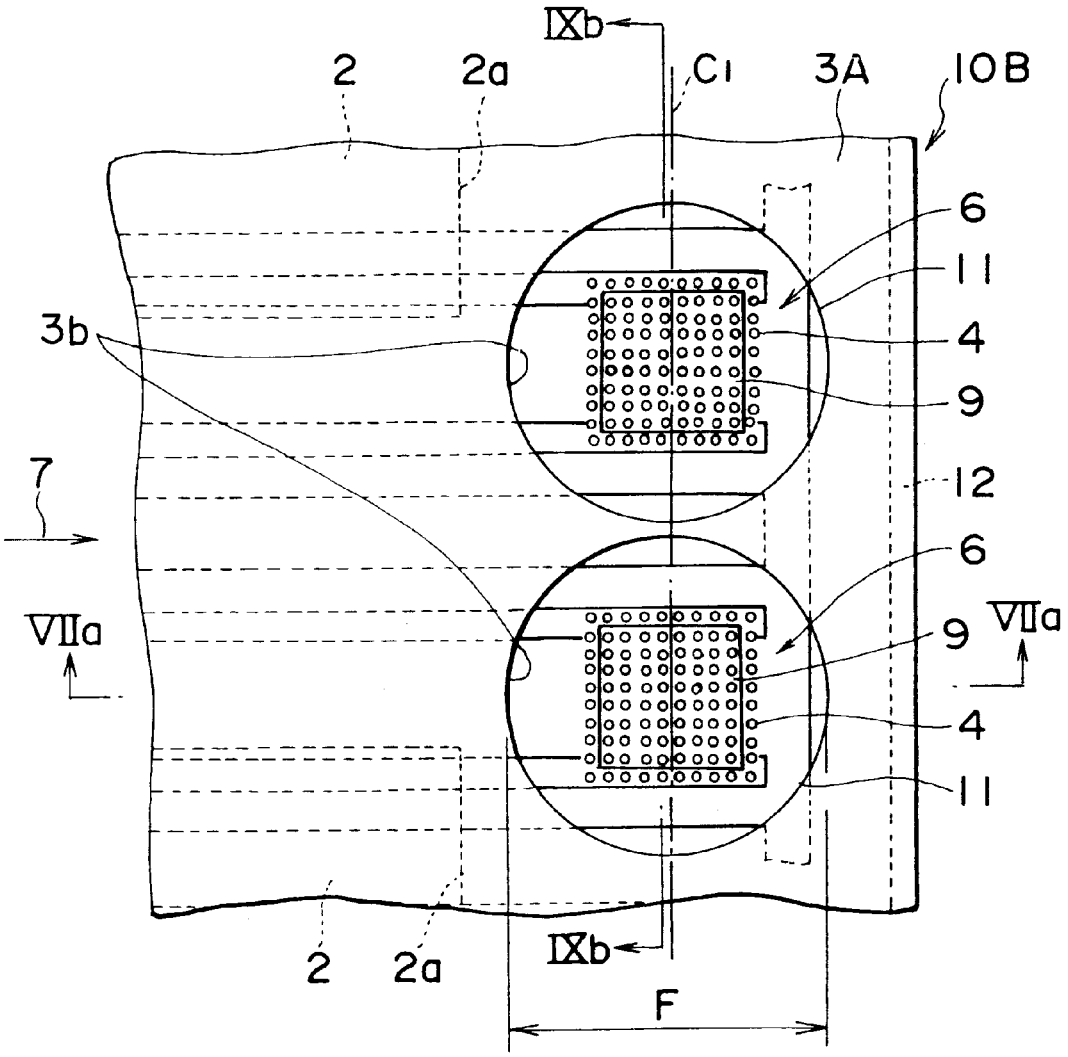
Figure 9B:
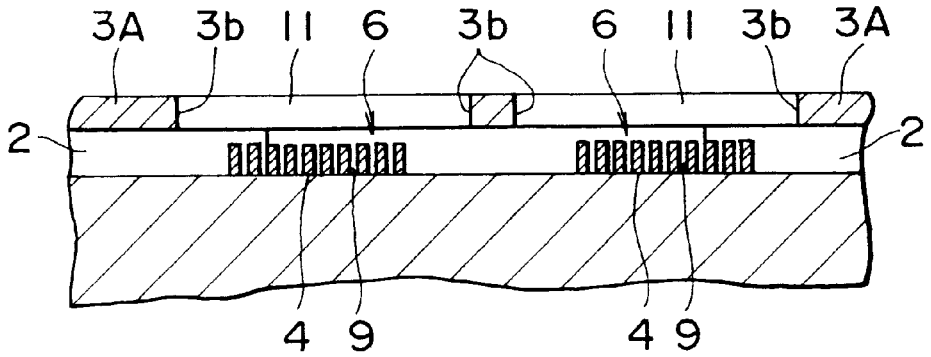

FIG. 9A is a plan view showing part of a head chip 10B according to a third embodiment; and FIG. 9B is a sectional view taken on line IXb—IXb of FIG. 9A. The cross-section taken on line VIIa—VIIa of FIG. 9A is the same as that shown in FIG. 7A, and therefore, it is not shown.

In this embodiment, as shown in FIG. 9A, a lid 3A prepared by forming the lid 3 in the second embodiment integrally with a lid 13 disposed opposite to the lid 3 is provided, to form a circular orifice 11 over a position corresponding to each dye flying portion 6. A size F of an opening portion of the orifice 11 is typically set at a value of 30 $\mu$m or more (for example, 60 to 200 $\mu$m). The head chip 10B in this embodiment, having such a configuration, can be also manufactured without complicating the manufacturing steps.

Figure 10:
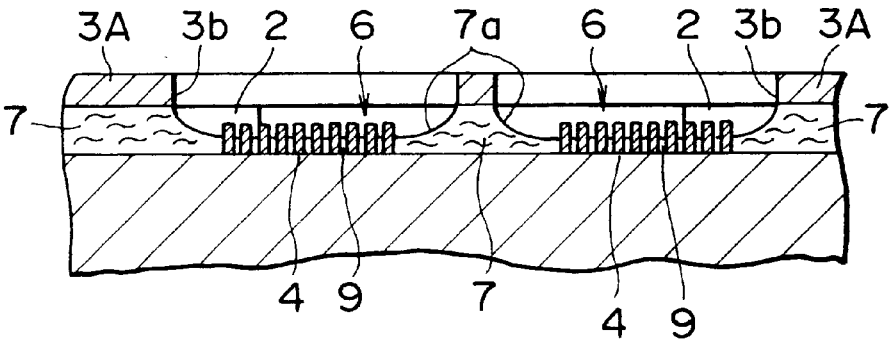
FIG. 10 is a schematic sectional view showing the meniscus of the dye in the portion shown in FIGS. 9A and 9B.

In this embodiment, a meniscus forming means which circularly surrounds each dye flying portion 6 is formed by an edge 3*b* of the orifice 11, and as shown in FIG. 10, the meniscus 7*a* of the dye 7 is formed between the entire edge 3*b* of the orifice 11 and each dye flying portion 6. As a result, it is possible to form the meniscus 7*a* in a state more desirable than that of the meniscus 7*a* in the second embodiment, and hence to hold the dye 7 at a desired height A of the dye 7 (see FIG. 5). Also since the flying direction of the dye 7 is restricted by the orifice 11, it is possible to form a desired dot.

According to this embodiment, since the meniscus 7*a* of the dye 7 is formed by the meniscus forming means surrounding each dye flying portion 6 and a desired recording can be obtained by restricting the flying direction of the dye 7, it is possible to form the meniscus 7*a* of the dye 7 being equal to or more than that in the second embodiment.

Fourth Embodiment

Figure 11:
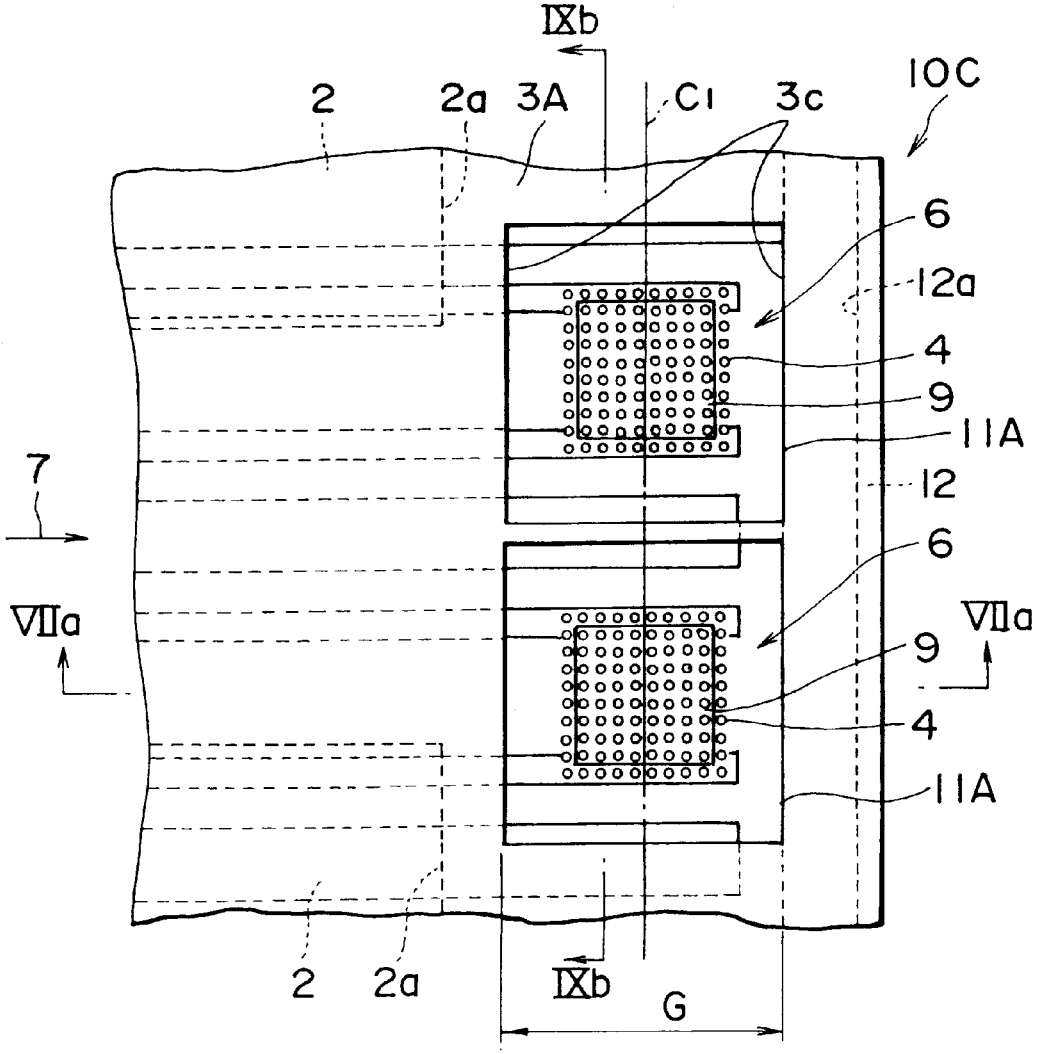
FIG. 11 is a schematic sectional view showing part of a head chip according to a fourth embodiment.

FIG. 11 is a plan view showing part of a head chip 10C according to a fourth embodiment. The cross-section taken on line VIIa—VIIa of FIG. 11 is the same as that shown in FIG. 7A and the cross-section taken on line IXb—IXb of FIG. 11 is the same as that shown in FIG. 9B, and therefore, they are not shown.

In this embodiment, as shown in FIG. 11, a square orifice 11A is provided over a position corresponding to each dye flying portion 6 by forming a lid 3A in the same manner as that in the third embodiment. A size G of an opening portion of the orifice 11A is typically set at a value of 30 $\mu$m or more (for example, 60 to 200 $\mu$m). The head chip 10C in this embodiment, having such a configuration, can be also manufactured without complicating manufacturing steps.

In this embodiment, a meniscus forming means which surrounds each dye flying portion 6 is formed by a square edge 3*c* of the orifice 11A, to form the meniscus 7*a* being substantially similar to that obtained in the third embodiment (see FIG. 10). That is to say, it is possible to form the desired meniscus 7*a* of the dye 7 and to restrict the flying direction of the dye 7 like the third embodiment.

According to this embodiment, there can be obtained an effect comparable to that obtained by the third embodiment by forming the meniscus comparable to that obtained in the third embodiment.

Fifth Embodiment

Figure 12:
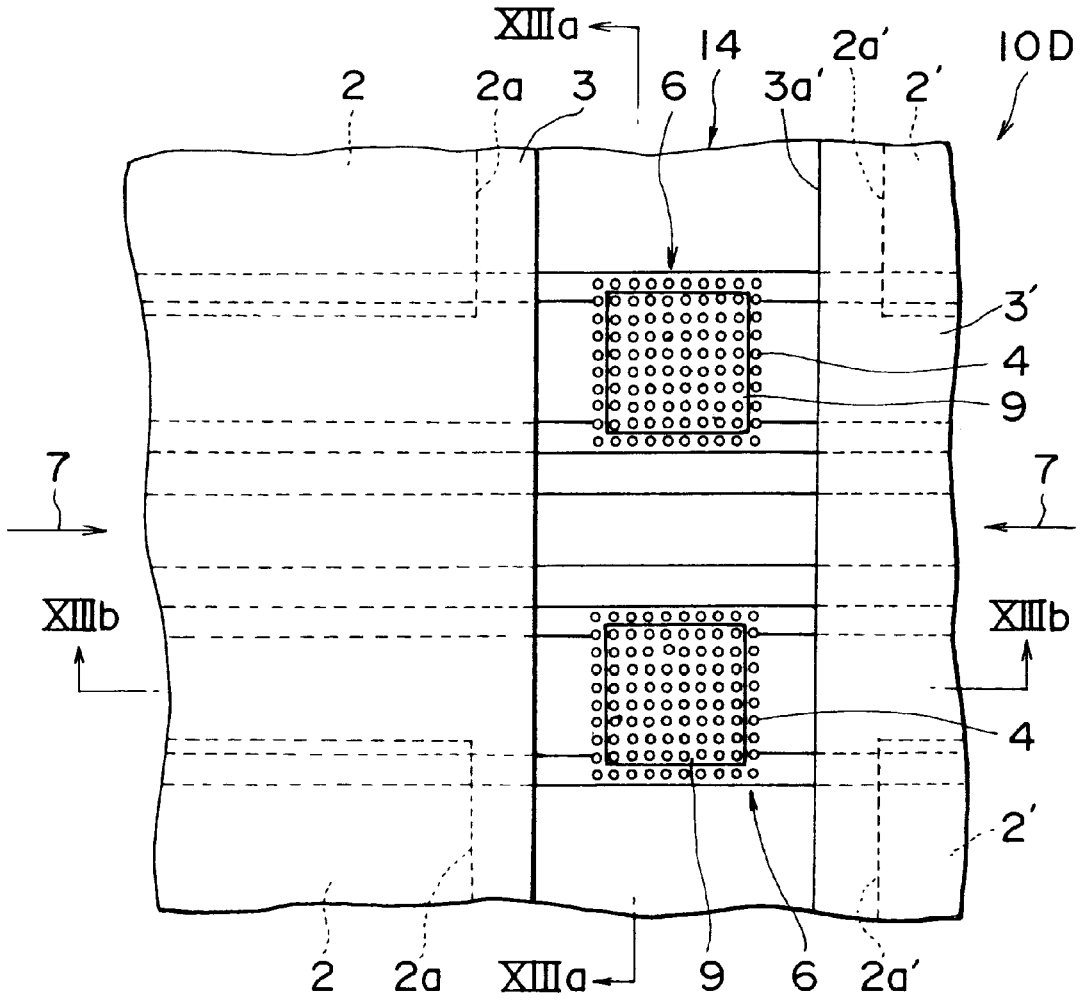
FIG. 12 is a schematic plan view showing part of a head chip according to a fifth embodiment.
Figure 13A:
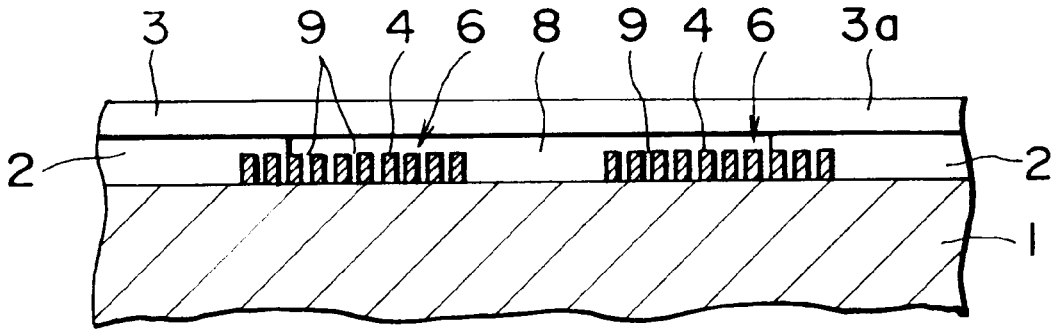

FIG. 12 is a plan view showing part of a head chip 10D according to a fifth embodiment. FIG. 13A is a sectional view taken on line XIIIa–XIIIa of FIG. 12, and FIG. 13B is a sectional view taken on line XIIIb—XIIIb of FIG. 12.

Figure 13B:
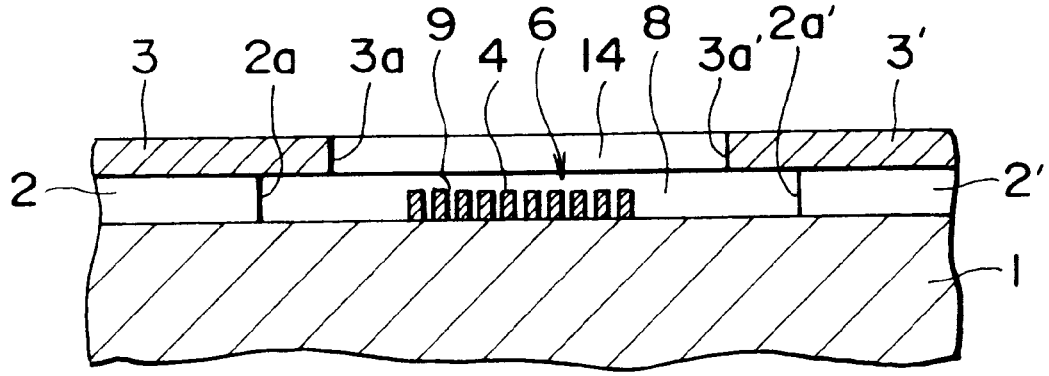

In this embodiment, as shown in FIGS. 12 and 13B, partition walls 2' and a lid 3' are disposed symmetrically to the partition walls 2 and the lid 3 in the first embodiment with the dye flying portions 6 put therebetween for allowing the dye 7 to be also supplied from the opposed side to the dye flying portions 6. In this case, a slit structure is formed over the dye flying portions 6. The head chip 10D in this embodiment, having such a configuration, can be simply manufactured without complicating the manufacturing steps.

As described above, in this embodiment, the dye 7 is also supplied from spaces between the partition walls 2' opposite to the partition walls 2, base plate 1 and lid 3' by the capillary phenomenon. That is to say, as shown in FIG. 12, the dye 7 is supplied to the dye flying portions 6 from both the sides.

Figure 14:
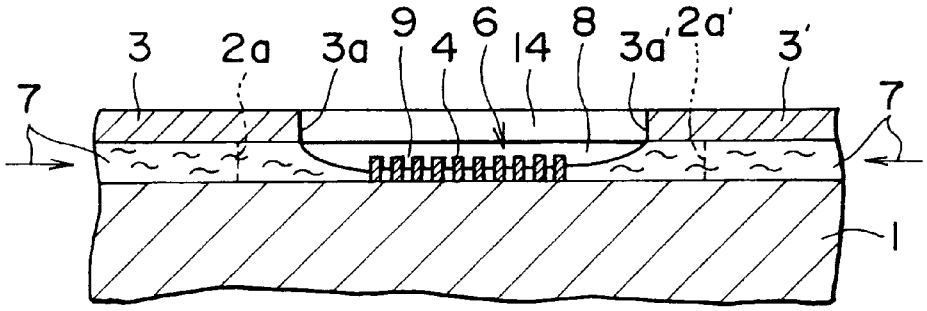
FIG. 14 is a schematic sectional view showing a meniscus of the dye in the portion shown in FIG. 12.

In this embodiment, a meniscus forming means is formed by the opposed edges 3*a* and 3a' of the lids 3 and 3', so that the meniscus 7*a* of the dye 7, which is substantially similar to that in the second embodiment, can be formed as shown in FIG. 14. In this embodiment, since the dye 7 is advantageously supplied to the dye flying portions 6 from both the dye supply passages, it is possible to easily form the desired meniscus 7*a*.

According to this embodiment, since the meniscus 7*a* substantially similar to that in the second embodiment is formed and the dye 7 is advantageously supplied from both the sides, there can be obtained an effect equal to or more than that obtained by the second embodiment.

Sixth Embodiment

Figure 15:
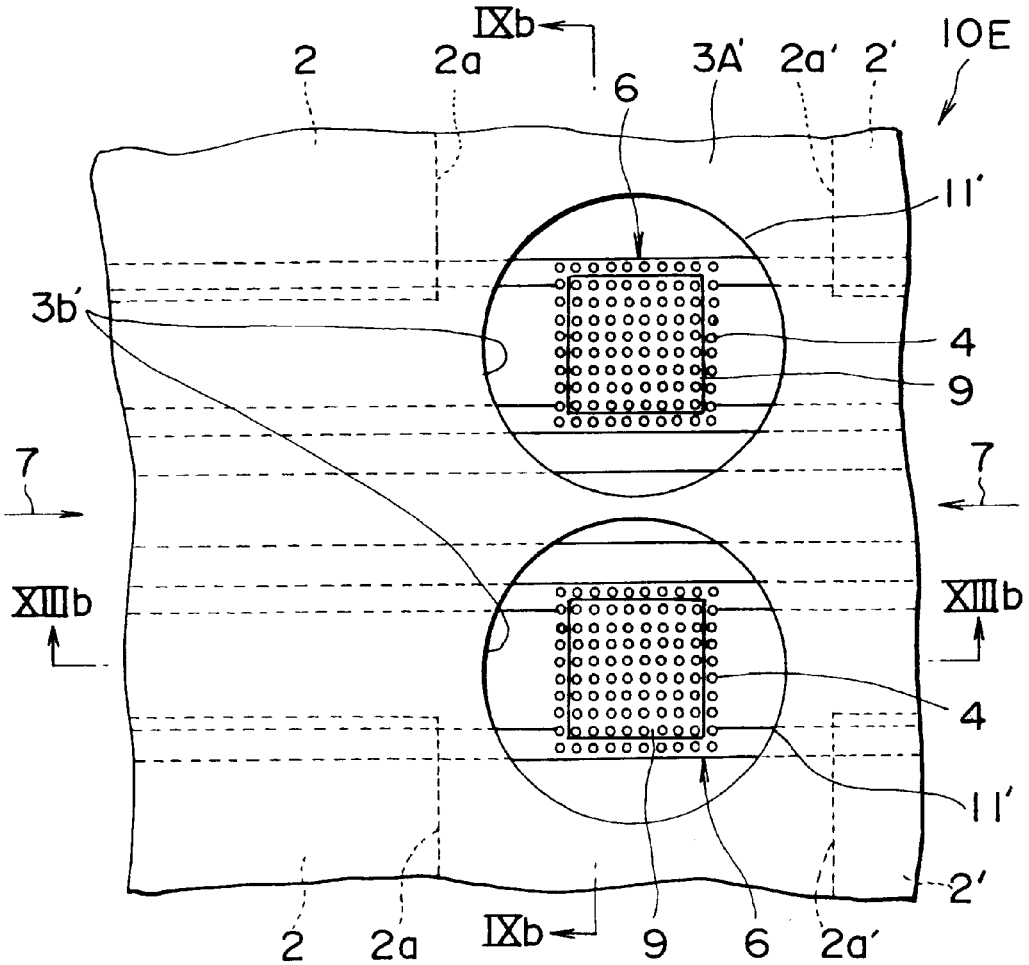
FIG. 15 is a schematic plan view showing part of a head chip according to a sixth embodiment of the present invention.

FIG. 15 is a plan view showing part of a head chip 10E according to a sixth embodiment. The cross-section taken on line IXb—IXb of FIG. 15 is the same as that shown in FIG. 9B, and the cross-section taken on line XIIIb—XIIIb of FIG. 15 is the same as that shown in FIG. 13B, and therefore, they are not shown.

This embodiment provides, as shown in FIG. 15, a structure similar to that in the fifth embodiment, in which the dye 7 is supplied to the dye flying portions 6 from both the sides. To be more specific, a lid 3A' is integrally formed like the third embodiment shown in FIGS. 9A and 9B, which lid is placed on the partition walls 2 and 2' opposite to each other with the dye flying portion 6 put therebetween. Like the third embodiment shown in FIGS. 9A and 9B, a circular orifice 11' is formed over each dye flying portion 6. The head chip 10E in this embodiment, having such a configuration, can be also manufactured without complicating the manufacturing steps.

In this embodiment, a meniscus forming means is formed by the entire edge 3*b*' of the orifice 11', and like the fifth embodiment, the dye 7 is advantageously supplied from both the sides to easily form the meniscus 7*a*. In this way, it is possible to form the meniscus 7*a* similar to that obtained in the third embodiment, and to restrict the flying direction of the dye 7.

According to this embodiment, in addition to formation of the meniscus similar to that obtained in the third embodiment, there can be obtained an effect comparable to that obtained by the fifth embodiment by advantageously supplying the dye 7 from both the sides.

Seventh Embodiment

Figure 16:
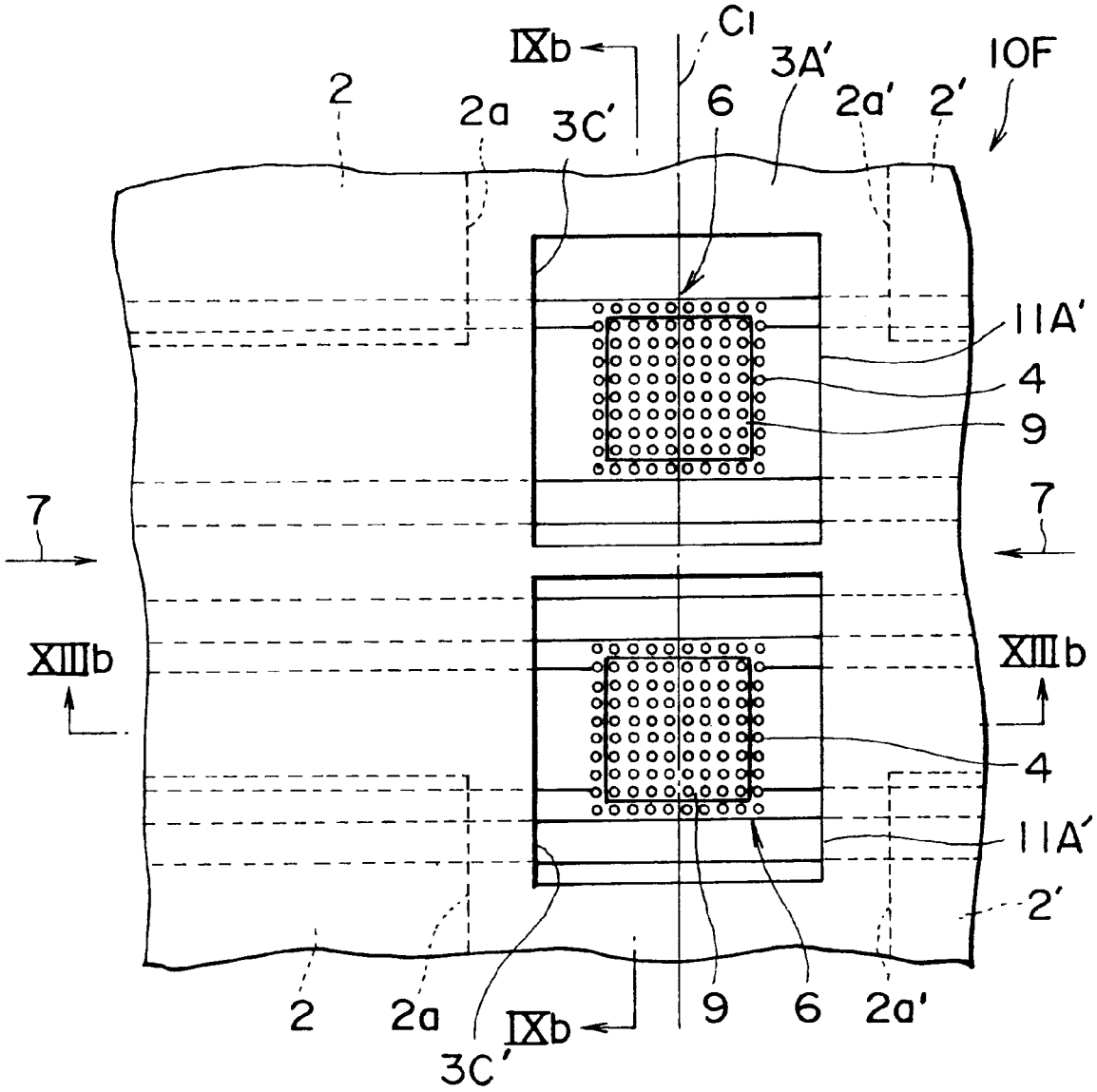
FIG. 16 is a schematic plan view showing part of a head chip according to a seventh embodiment of the present invention.

FIG. 16 is a plan view showing part of a head chip 10F according to a seventh embodiment. The cross-section taken on line IXb—IXb of FIG. 16 is the same as that shown in FIG. 9B and the cross-section taken on line XIIIb—XIIIb of FIG. 16 is the same as that shown in FIG. 13B, and therefore, they are not shown.

In this embodiment, a square orifice 11A' similar to that in the fourth embodiment (see FIG. 11) is formed over each dye flying portion 6 in place of the circular orifice 11' in the sixth embodiment. The head chip 10F in this embodiment, having such a configuration, can be also manufactured without complicating the manufacturing steps.

In this embodiment, a meniscus forming means is formed by an edge 3*c*' of an opening portion of the square orifice 11A', like the fourth embodiment shown in FIG. 11, so that the dye 7 is advantageously supplied from both the sides of each dye flying portion 6 to form the meniscus 7*a* similar to that in the fourth embodiment and also the flying direction of the dye 7 can be restricted.

According to this embodiment, in addition to formation of the meniscus similar to that in the fourth embodiment, there can be obtained an effect comparable to that obtained by the sixth embodiment by advantageously supplying the dye 7 from both the sides.

Eighth Embodiment

Figure 17:
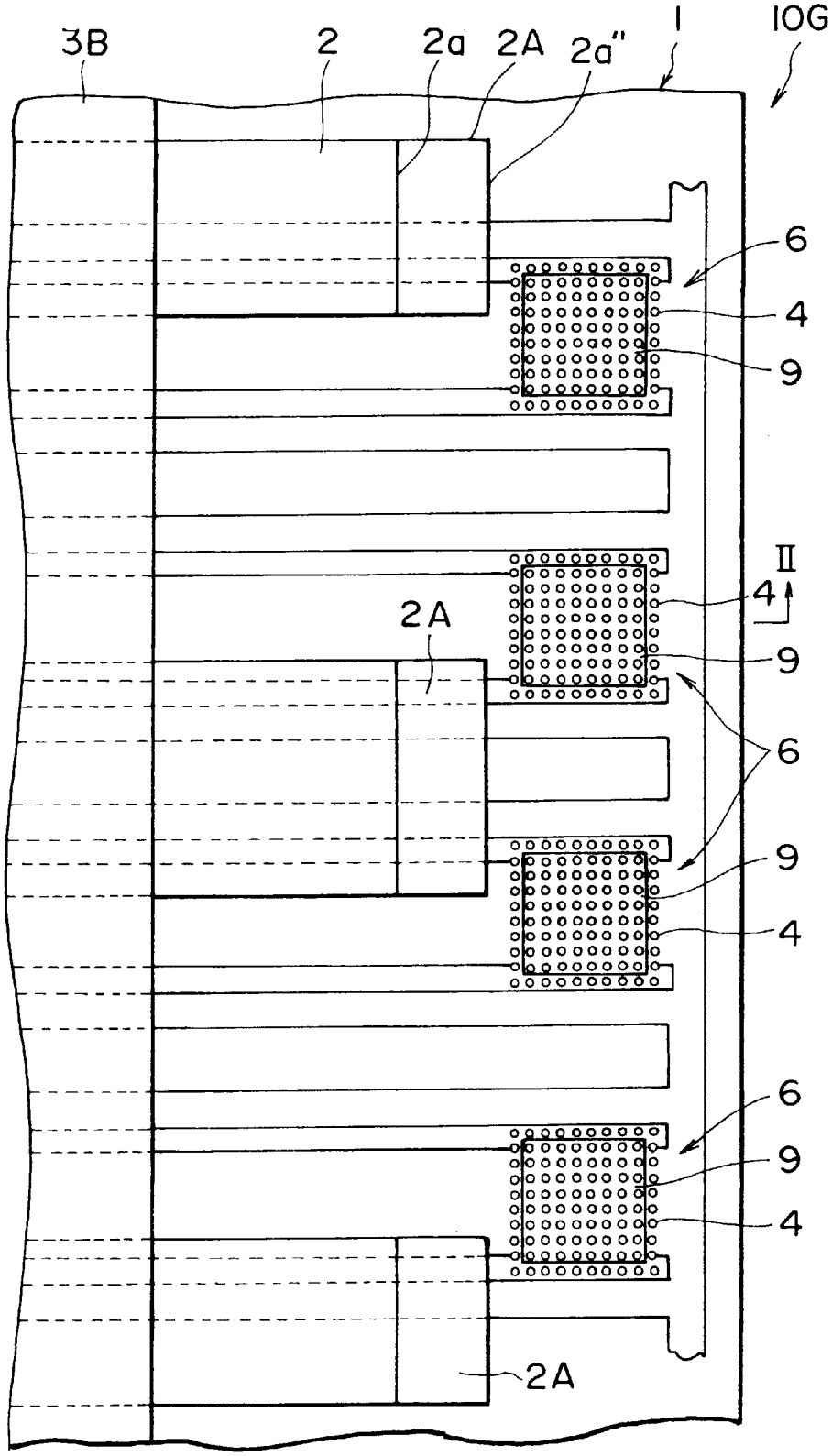
FIG. 17 is a schematic plan view showing part of a head chip according to an eighth embodiment of the present invention.

FIG. 17 is a plan view showing part of a head chip 10G according to an eighth embodiment.

Figure 48:
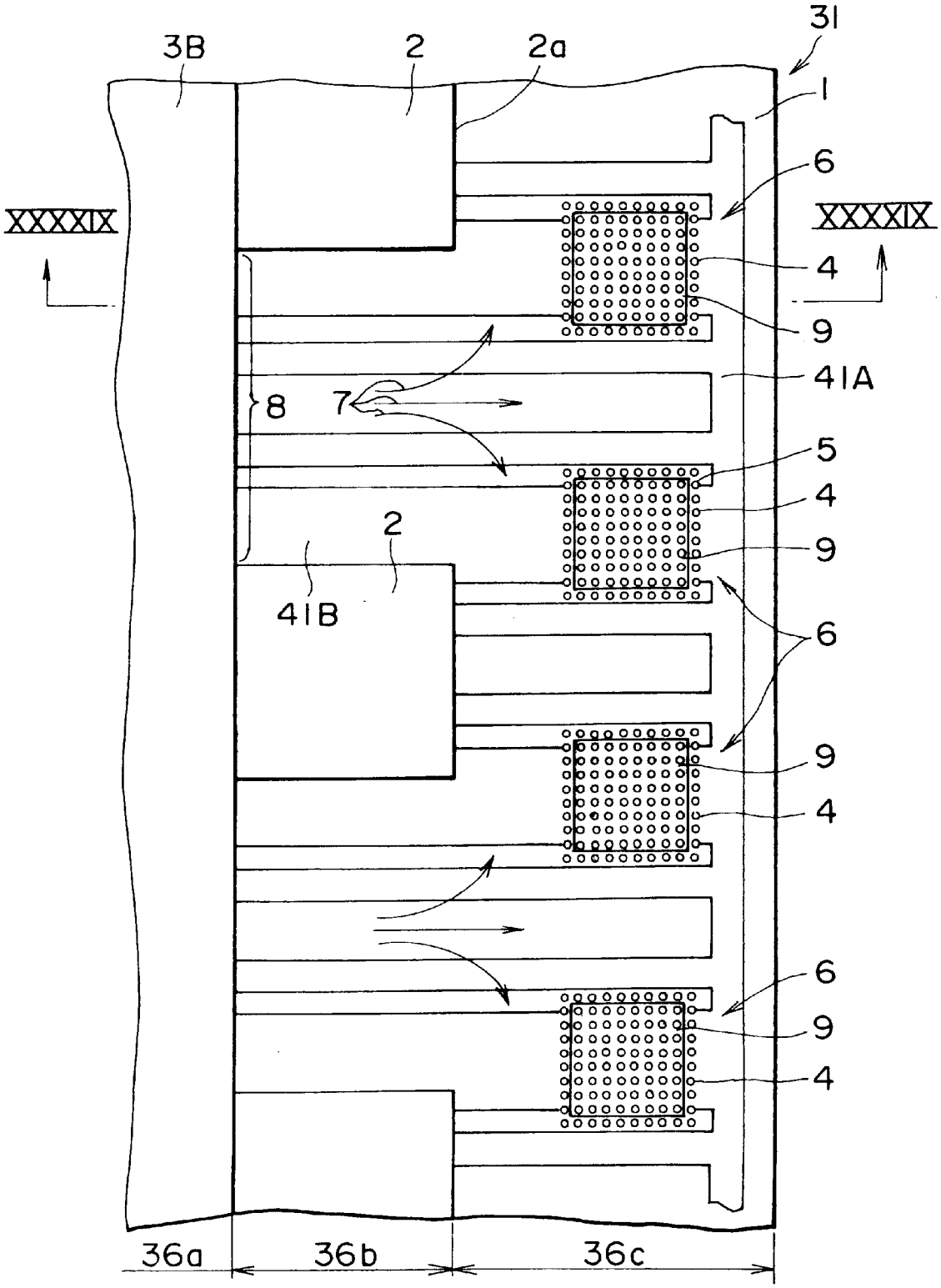
FIG. 48 is a schematic plan view showing part of a head chip of the printer head shown in FIG. 42.
Figure 49:
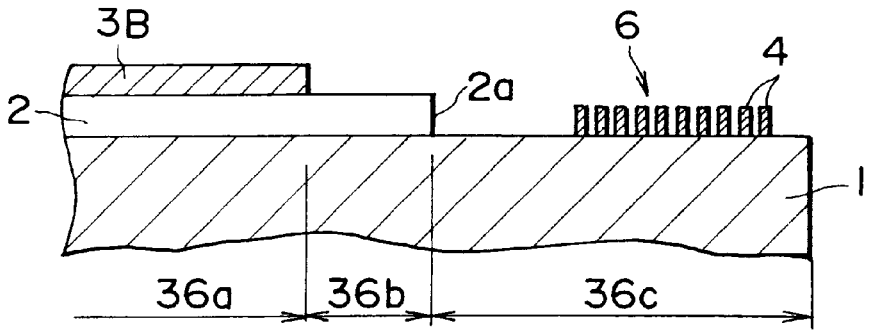
FIG. 49 is a schematic sectional view taken on line XXXXIX—XXXXIX of FIG. 48.
Figure 50:
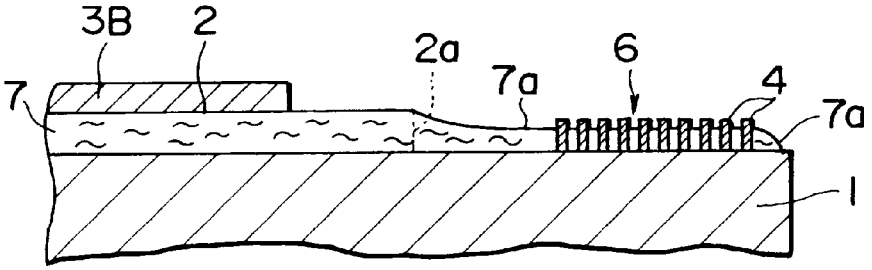
FIG. 50 is a schematic sectional view showing a meniscus of the dye at the portion shown in FIG. 49.

This embodiment is different from the above-described embodiments in that a partition wall 2A made from a material (for example, nickel which is the same material as that of the lid 3B) different from the partition wall 2 is formed, as a meniscus forming means, at the edge 2*a* of each partition wall 2 of the related art head chip shown in FIG. 48.

The partition walls 2A are not formed simultaneously with the partition walls 2 formed in the manufacturing steps of the head chip, but are separately finished and then stuck at specific positions.

The edge of each partition wall 2 formed by photolithography in the manufacturing steps of the head chip has, as described above, fine irregularities in the microscopic view. The irregularities of the edge of the partition wall 2 obstruct the formation of the meniscus having a desired shape. Accordingly, the material having a thickness being as thin as for example 20 μm is separately finished and then stuck at specific positions. In this embodiment, however, the meniscus can be stably formed without complicating the manufacturing steps.

Since the edges 2*a*" of the partition walls 2A extending from the partition walls 2, which edges are accurately prepared without irregularities, are positioned in the vicinity of the dye flying portions 6, the meniscus having a desired shape can be formed by the edges 2*a*" of the extending partition walls 2A, to thereby hold the dye 7 in the dye flying portions 6 in an amount necessary for flying of the dye 7.

According to this embodiment, the edges 2*a*" of the extending partition walls 2A are positioned in the vicinity of the dye flying portions 6, so that the meniscus of the dye 7 capable of supplying the dye 7 in an amount necessary for flying of the dye 7 can be formed in the dye flying portions 6. Also since the separately finished materials are stuck as the partition walls 2A, the edges 2*a*" of the extending partition walls 2A can be accurately, simply finished.

Ninth Embodiment

Figure 18:
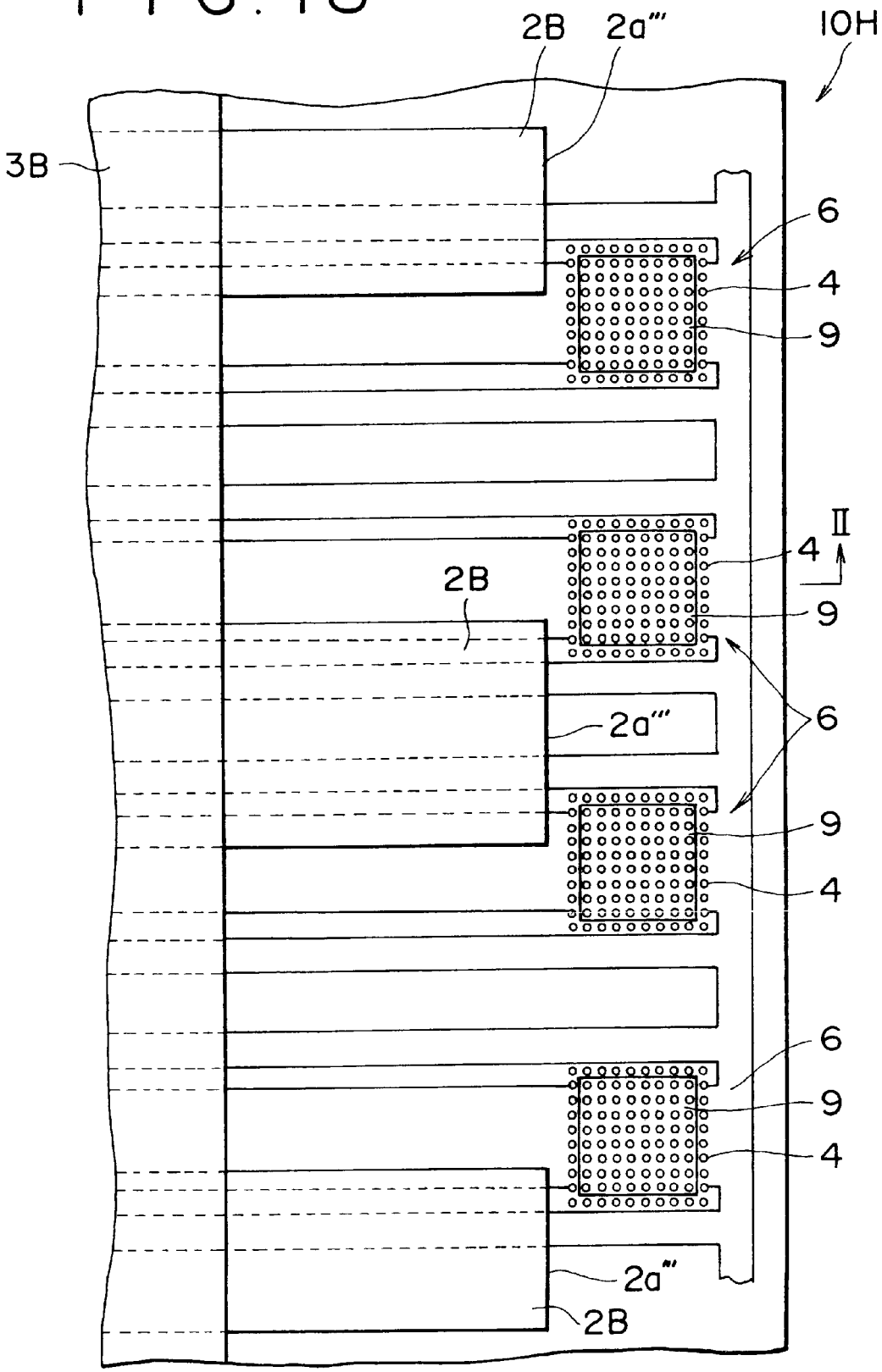
FIG. 18 is a schematic plan view showing part of a head chip according to a ninth embodiment of the present invention.

FIG. 18 is a plan view showing part of a head chip 10H according to a ninth embodiment.

While the eighth embodiment is configured such that the partition walls 2 are extended by sticking the separately finished materials at specific positions as the extending partition walls 2A, the ninth embodiment is configured such that partition walls 2B, each being formed of a resist sheet having a size allowing its edge 2*a*'" to be positioned in the vicinity of the dye flying portion 6, are separately finished and then stuck at specific positions, to thus form a meniscus forming means.

The partition walls 2B and the lid 3B are not formed by photolithography in the manufacturing steps of the head chip 10H, but separately prepared and then stuck at specific positions. With this configuration, the edges 2*a*'" of the partition walls 2B can be accurately formed without irregularities, and the head chip can be manufactured without complicating the manufacturing steps.

According to this embodiment, there can be obtained an effect comparable to that obtained by the eighth embodiment.

Tenth Embodiment

Figure 19:
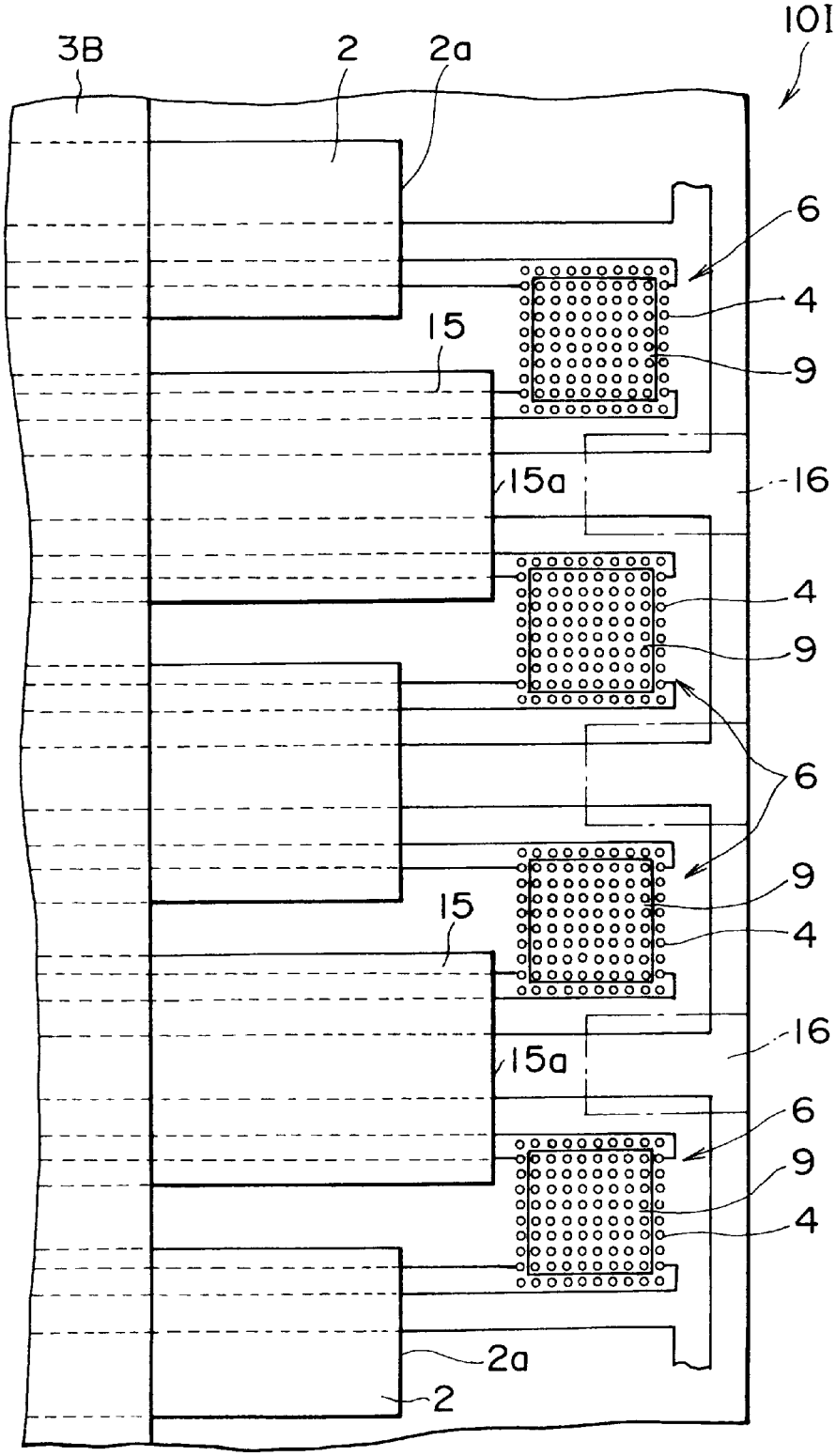
FIG. 19 is a schematic plan view showing part of a head chip according to a tenth embodiment of the present invention.

FIG. 19 is a plan view showing part of a head chip 10I according to a tenth embodiment.

As shown in FIG. 19, in the head chip 10I in this embodiment, an auxiliary wall 15 functioning as a meniscus forming means is provided between the two adjacent partition walls 2 of the related art head chip shown in FIG. 48 in such a manner that an edge 15*a* of the auxiliary wall 15 is positioned in the vicinity of the dye flying portion 6. Also, by provision of another auxiliary wall 16 shown by the virtual line in FIG. 19 opposite to the edge 15*a* of the auxiliary wall 15, the effect can be further improved. The auxiliary wall 16 is deteriorated by heating, and therefore, it may be positioned with a specific distance put between the heater and the auxiliary wall 16.

The auxiliary walls 15 in this embodiment are separately finished using a resist sheet, nickel sheet or the like and are then stuck at specific positions, and the lid 3B is stuck on the auxiliary walls 15 after sticking of the auxiliary walls 15. The head chip 10I in this embodiment, having such a configuration, can be also manufactured without complicating the manufacturing steps.

In this embodiment, since the edges 15*a* of the auxiliary walls 15 are positioned in the vicinity of the dye flying portions 6, the meniscus of the dye 7, which is formed in the region from the edges 2 of the partition walls 2 to the dye flying portions 6 and thereby the meniscus of the dye 7 makes small the thickness of the dye 7 if the auxiliary walls 15 are not provided, can be kept in a desired state by provision of the auxiliary walls 15.

According to this embodiment, there can be obtained an effect comparable to that obtained by each of the embodiments 8 and 9.

The method of manufacturing the head chip described in each of the previous embodiments will be briefly described in the order of the manufacturing steps. FIGS. 20 to 32 are schematic sectional views showing the manufacturing steps, and FIGS. 33 to 40 are schematic plan views showing the steps corresponding to part of the steps shown in FIGS. 20 to 32.

Figure 20:
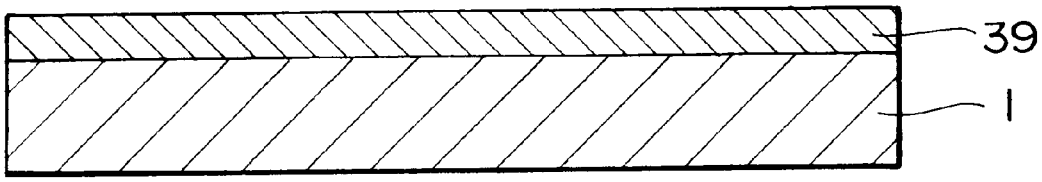
FIGS. 20 to 32 are schematic sectional views showing steps of manufacturing a head chip.

First, as shown in FIG. 20, in the method of manufacturing a head chip according to this embodiment, a silicon wafer excellent in heat radiation characteristic (high in thermal conductivity) is used as a base plate 1 of the head chip. A $SiO_2$ layer 39 is formed on the base plate 1 to a thickness of about 1 to 2 μm by thermal oxidation or CVD (chemical vapor-phase deposition). The $Sio_2$ layer 39 acts as a heat accumulating layer directly under a heater, and therefore, the thickness of the $Sio_2$ layer 39 is required to be determined in consideration of the heat radiation characteristic of an aluminum heat sink constituting the base.

Figure 21:
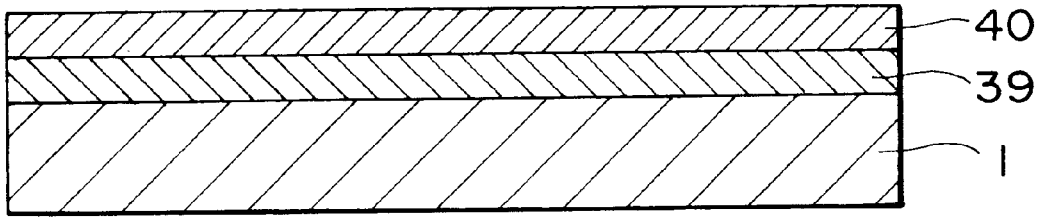

A polysilicon layer 40 serving as a resistor (heater) is, as shown in FIG. 21, formed on the $SiO_2$ layer 39 to a thickness of about 0.4 μm by a low pressure CVD or the like. The polysilicon layer 40 is doped with phosphorus (P) to set the sheet resistance thereof at about 4 kΩ.

Figure 22:
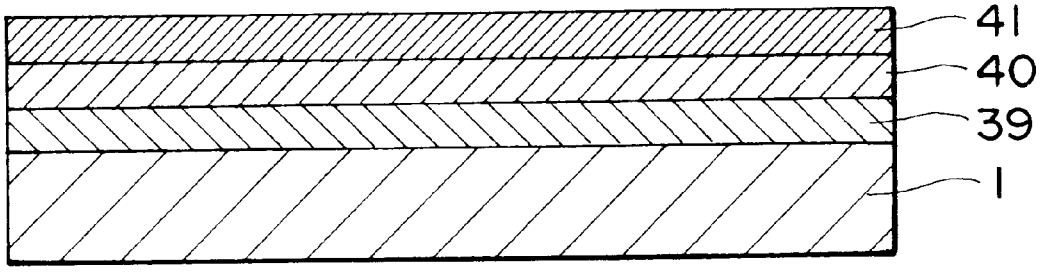

An aluminum layer 41 is, as shown in FIG. 22, formed on the polysilicon layer 40 to a thickness of about 0.5 μm by sputtering. In this case, a metal other than aluminum, which metal is represented by gold, copper or platinum, may be used as a conductor.

Figure 23:
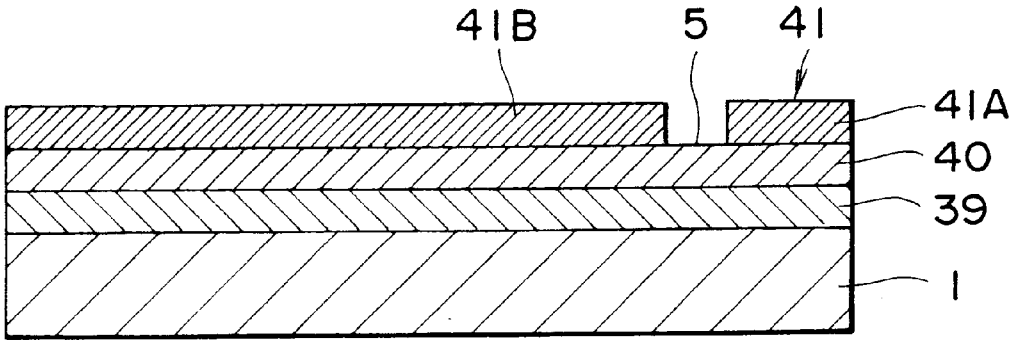
Figure 33:
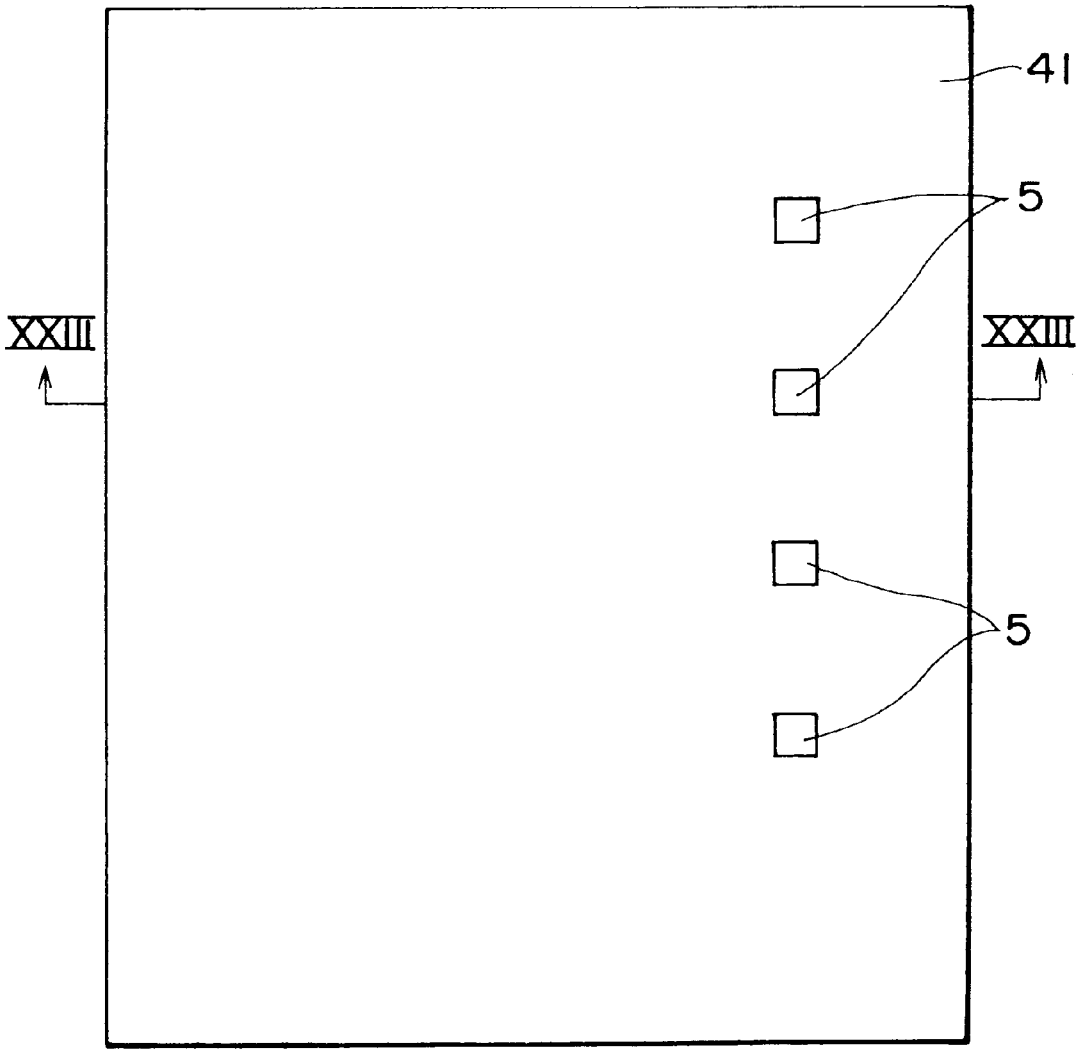
FIGS. 33 to 39 are schematic plan views showing steps corresponding to part of the steps of manufacturing the head chip shown in FIGS. 22 to 32.

To expose portions, at which heaters 5 are to be formed, of the polysilicon layer 40, as shown in FIG. 23 (sectional view taken on line XXIII—XXIII of FIG. 33) and FIG. 33, a photoresist having a specific pattern is formed on the aluminum layer 41 and the aluminum layer 41 is selectively removed by an etchant using the photoresist as a mask to expose the above portions of the polysilicon layer 40. FIG. 33 is a plan view showing the state after the above portions of the polysilicon layer 40, at which the heaters 5 are to be formed, are exposed. As the etchant for etching the aluminum layer 41, there is used a mixed acid (phosphoric acid: nitric acid: acetic acid: water=4:1:4:1). It should be noted that four pieces of the heaters 5 are shown in FIG. 33; however, five or more of the heaters 5 are actually provided (the same is true for the following description).

Figure 24:
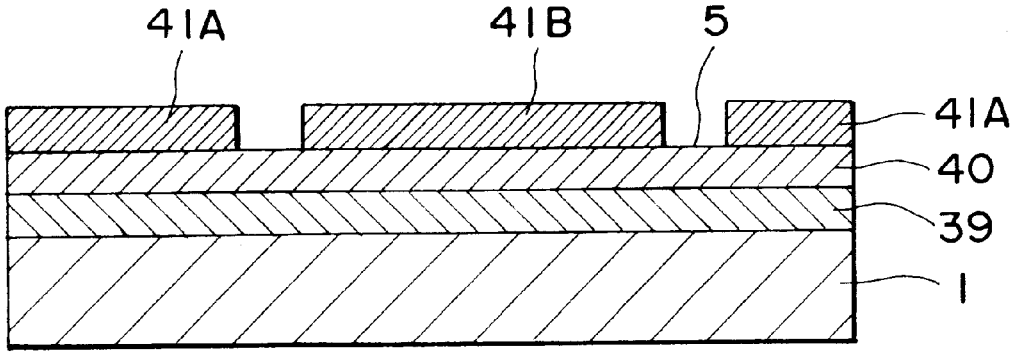
Figure 34:
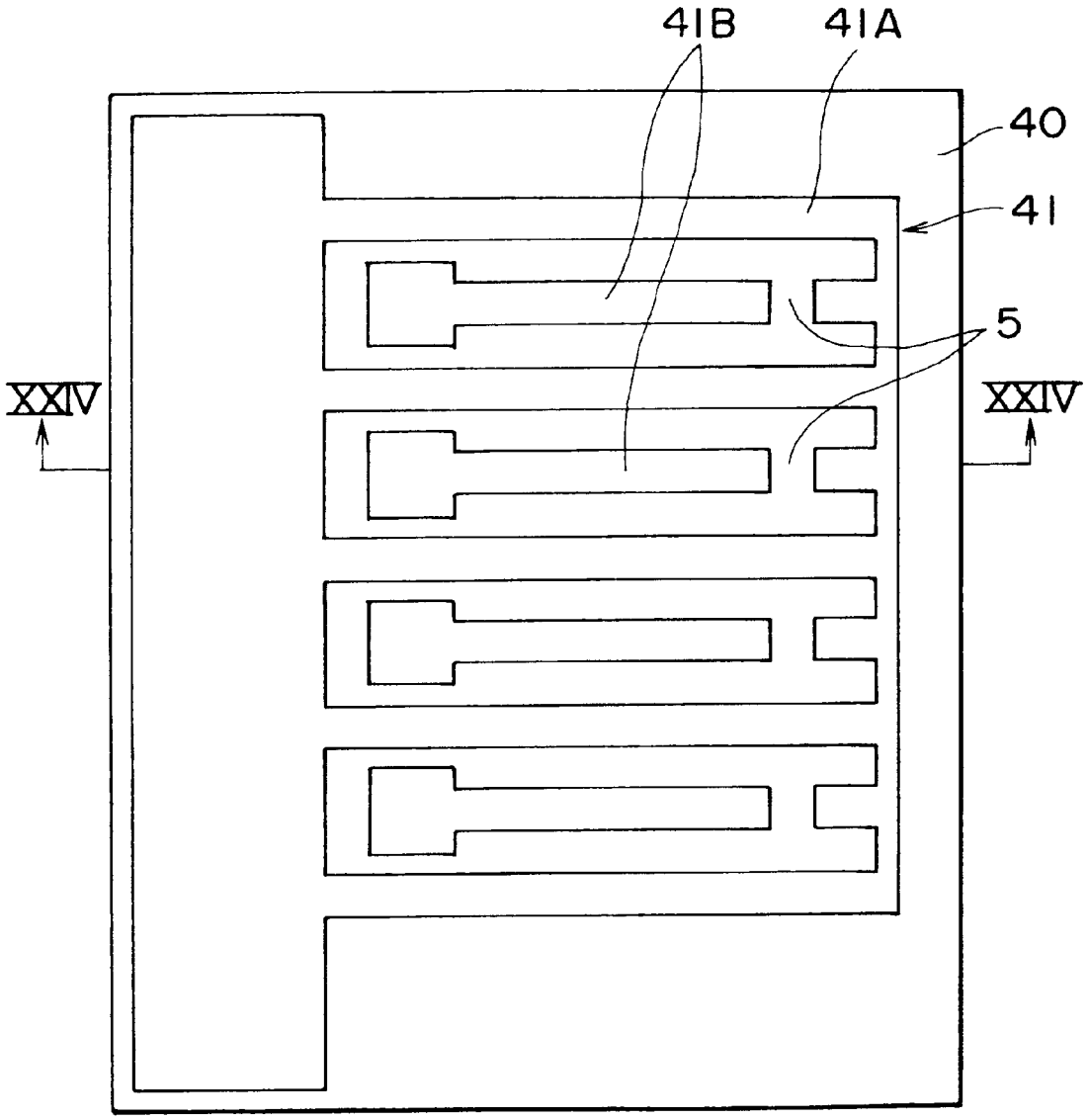

As shown in FIG. 24 (sectional view taken on line XXIV—XXIV of FIG. 34) and FIG. 34, a photoresist having a specific pattern of interconnections to be conductive to the heaters 5 is formed on the aluminum layer 41, and the aluminum layer 41 is etched by the above Al etchant using the photoresist as a mask, to form a conductive pattern having a common electrode 41A and individual electrodes 41B.

Figure 25:
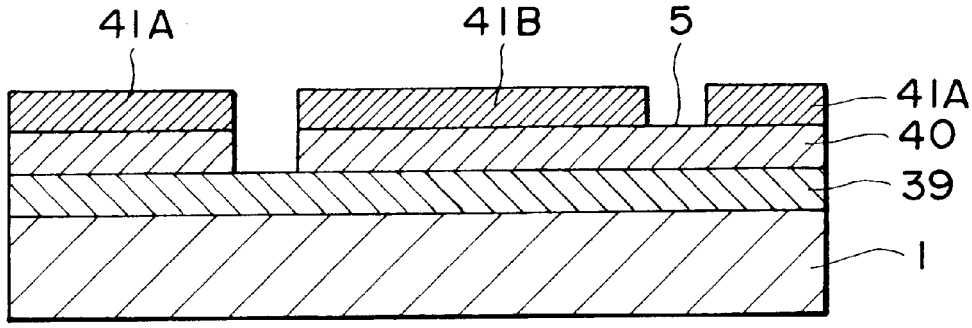
Figure 35:
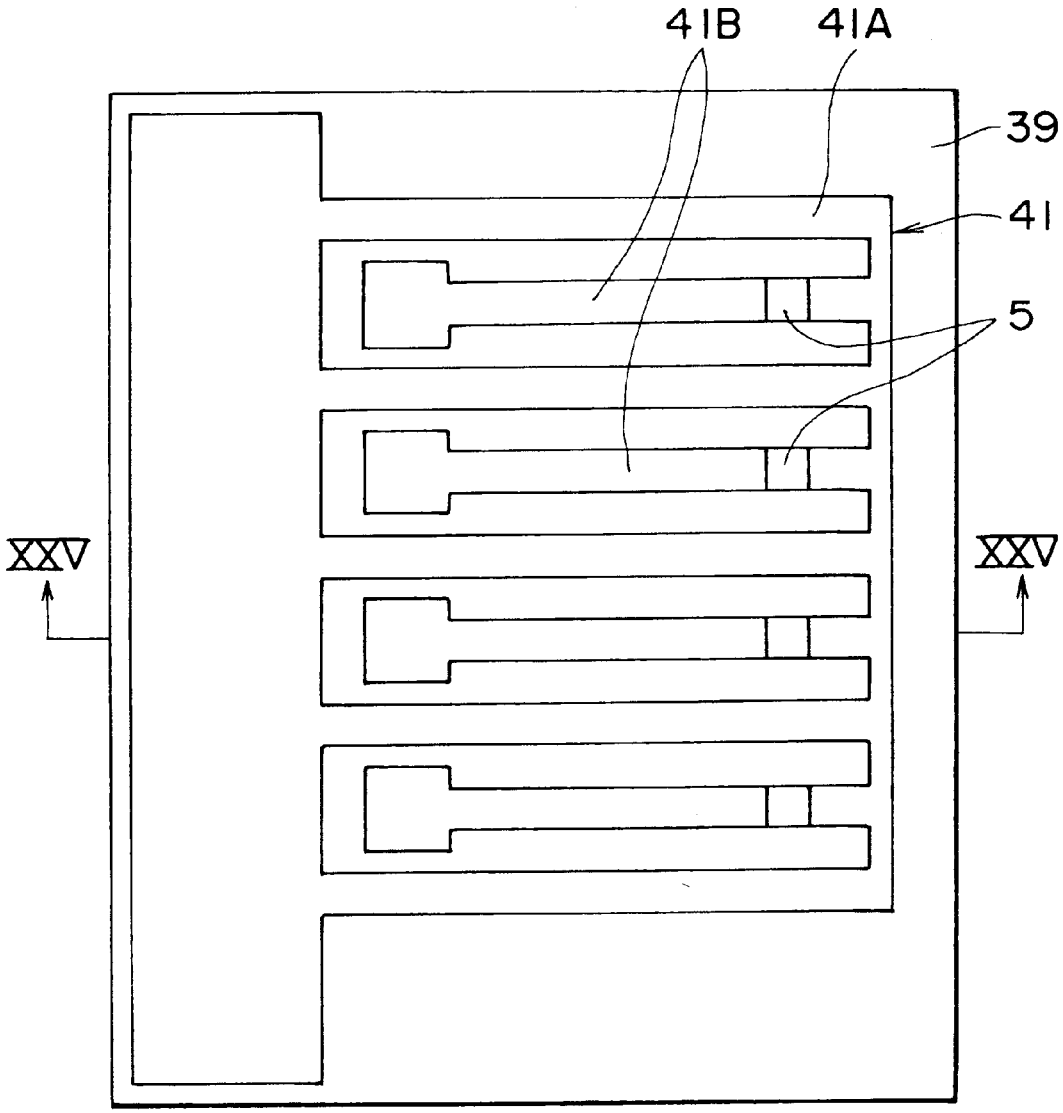

As shown in FIG. 25 (sectional view taken on line XXV—XXV of FIG. 35) and FIG. 35, since polysilicon is not etched by the Al etchant, the polysilicon layer 40 is etched into the same pattern as that of the aluminum layer 41 using the above photoresist as a mask by RIE (reactive ion etching) using $CF_4$ (carbon fluoride) gas.

At this time, since the portions, at which the heaters 5 are to be formed, of the polysilicon layer 40 are covered with the photoresist, they are not etched. In this way, the aluminum layer 41 and the polysilicon layer 40 are processed in the same conductive pattern except for the initially exposed portions of the polysilicon layer 40, and aluminum and polysilicon form ohmic contact, that is, become a conductor by heat-treatment to be carried out in the subsequent step. The initially exposed portions of the polysilicon form resistors having a high resistance and function as the resistance heating heaters 5.

Figure 26:
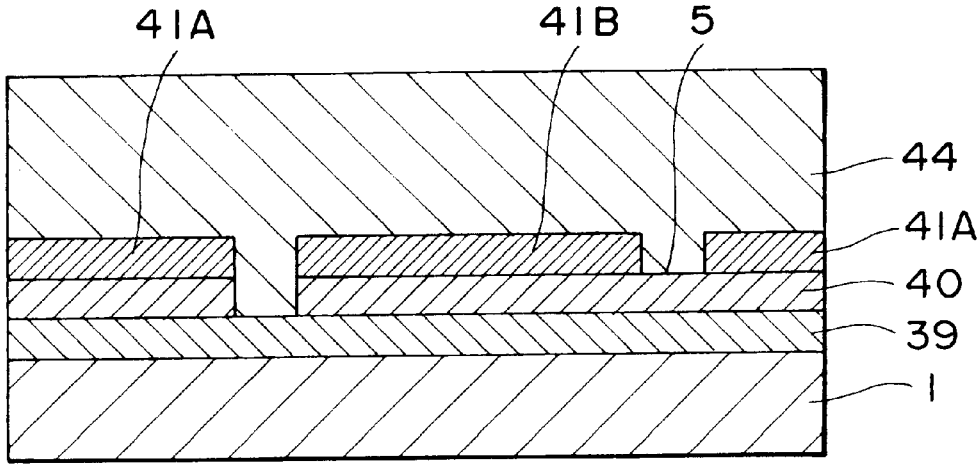

A $SiO_2$ film 44 is, as shown in FIG. 26, formed over the entire surface to a thickness of about 6 $\mu$m by CVD, and is then subjected to cylinder treatment for annealing in a nitrogen atmosphere at 450° C. for 30 min, to form ohmic contact between polysilicon and aluminum electrodes.

Figure 27:
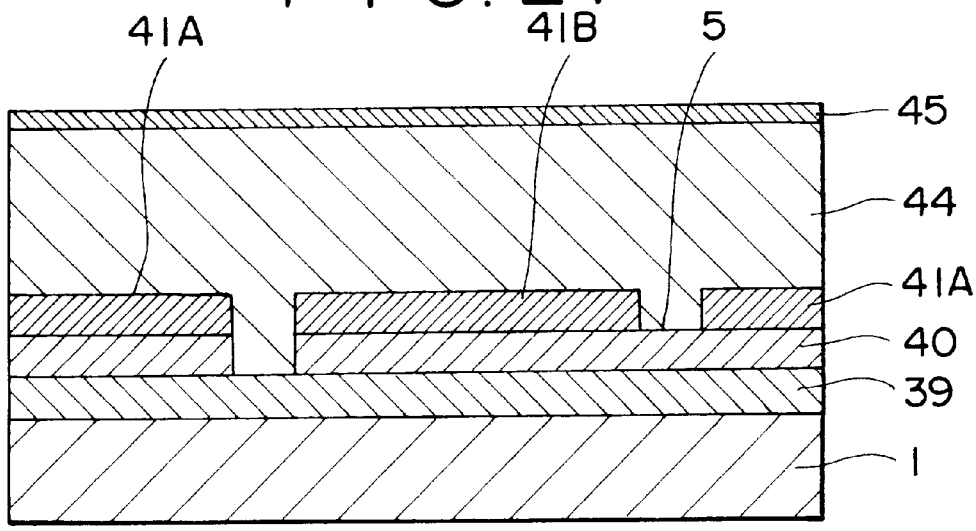

A chromium layer 45 acting as a metal mask upon formation of small pillars and dye storing portions is, as shown in FIG. 27, formed on the $SiO_2$ layer 44 to a thickness of about 0.2 $\mu$m by sputtering.

Figure 28:
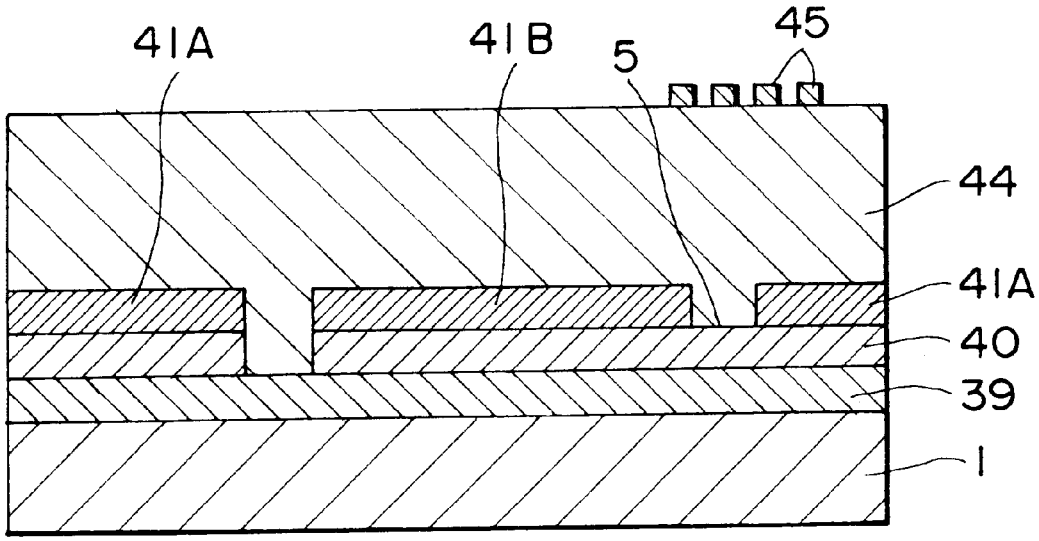
Figure 36:
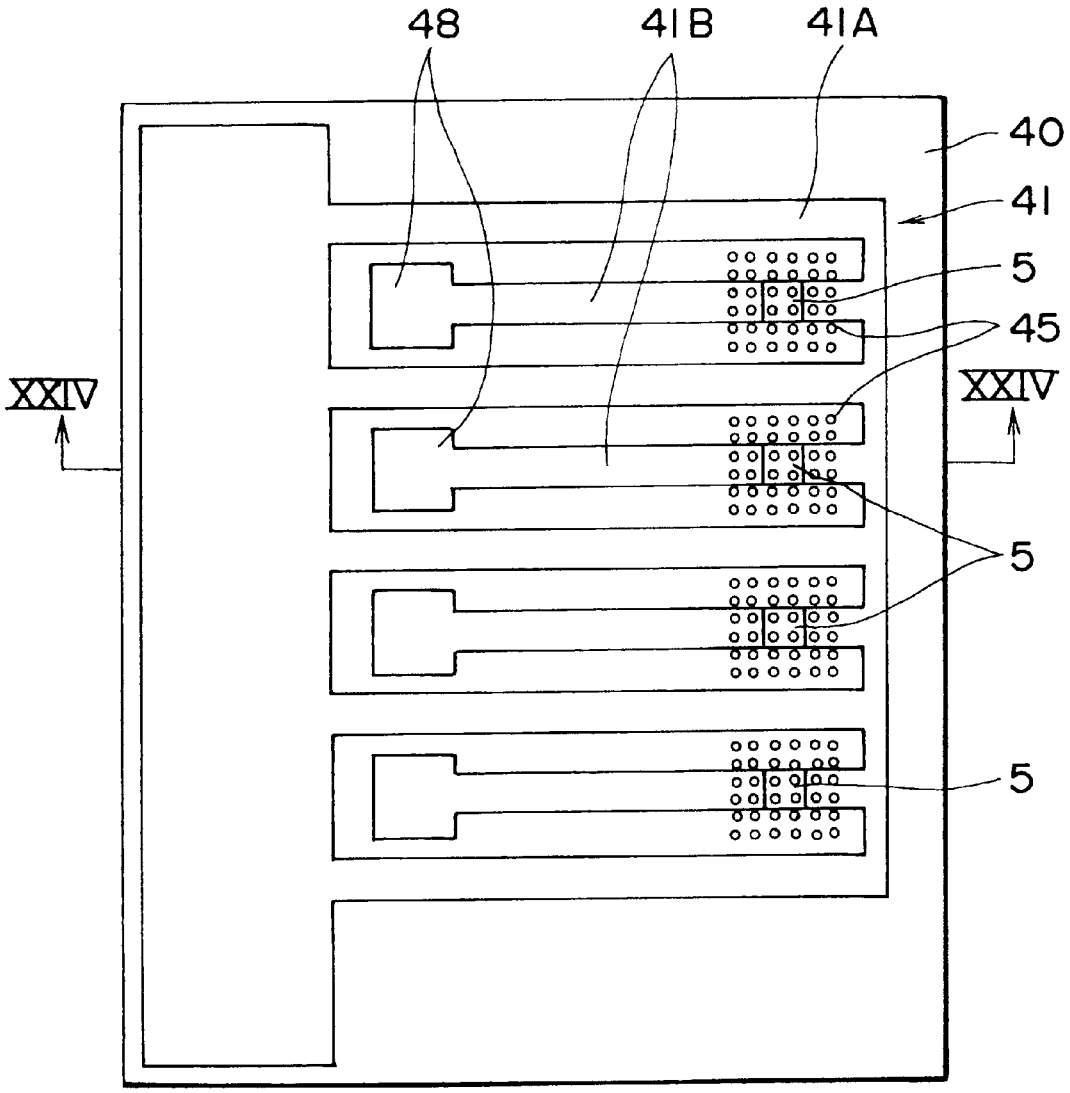

A photoresist having a specific pattern for forming the small pillars and dye storing portions is, as shown in FIG. 28, formed on the chromium layer 45, and the chromium layer 45 is selectively etched using the photoresist as a mask by RIE using a mixed gas of chlorine and oxygen, to form a metal mask 45. FIG. 36 is a plan view corresponding to FIG. 28. In FIG. 36, the $SiO_2$ layer 44 shown in FIG. 28 is omitted and only the metal mask 45 is shown.

Figure 29:
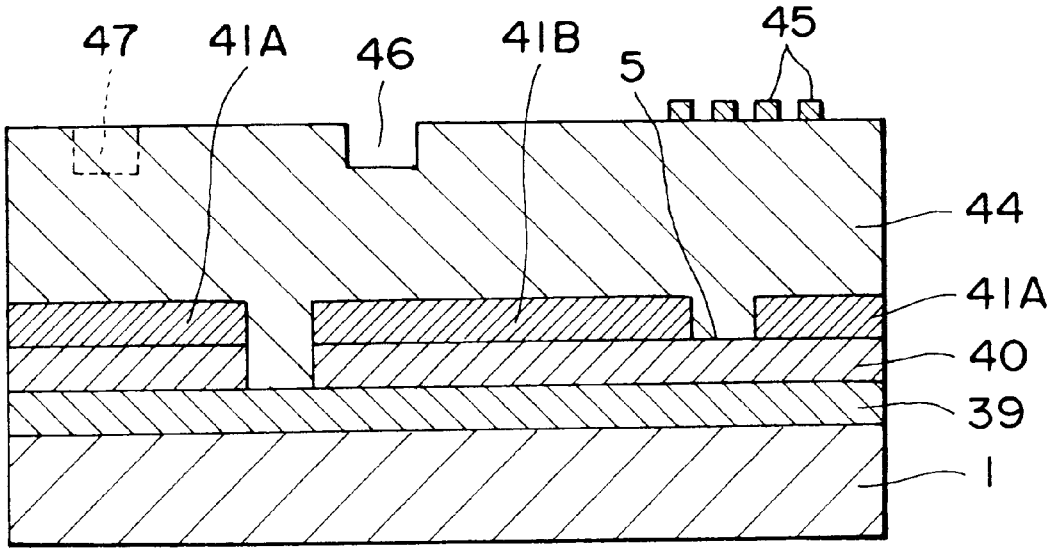

A photoresist having a specific pattern for opening bonding pads 46 and 47 adapted to lead electrodes is, as shown in FIG. 29, formed on the $SiO_2$ layer 44, and the $SiO_2$ layer 44 is selectively etched using the photoresist as a mask to a thickness of 1 $\mu$m by RIE. This step is performed to certainly open all the bonding pads for leading electrodes present on the wafer in the subsequent step for forming a group of the small pillars and dye storing portions.

Figure 30:
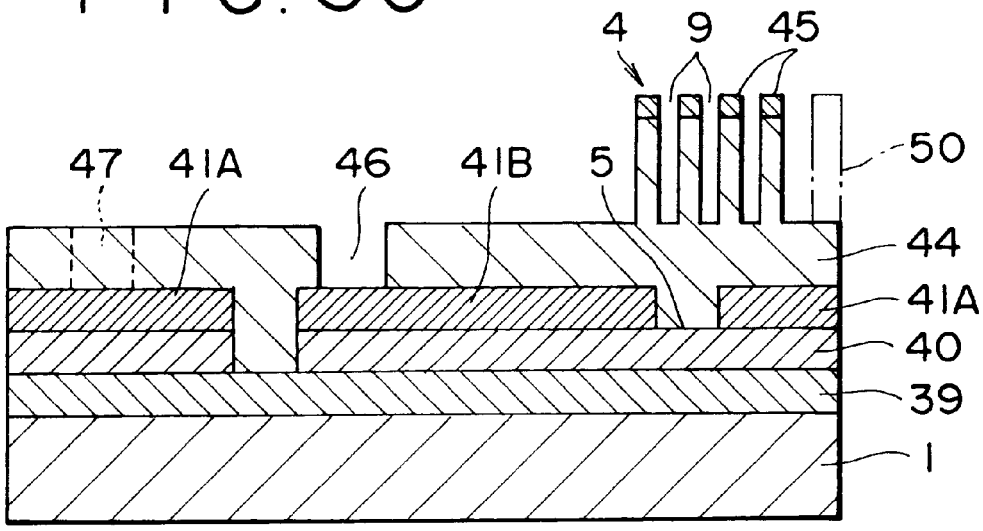
Figure 37:
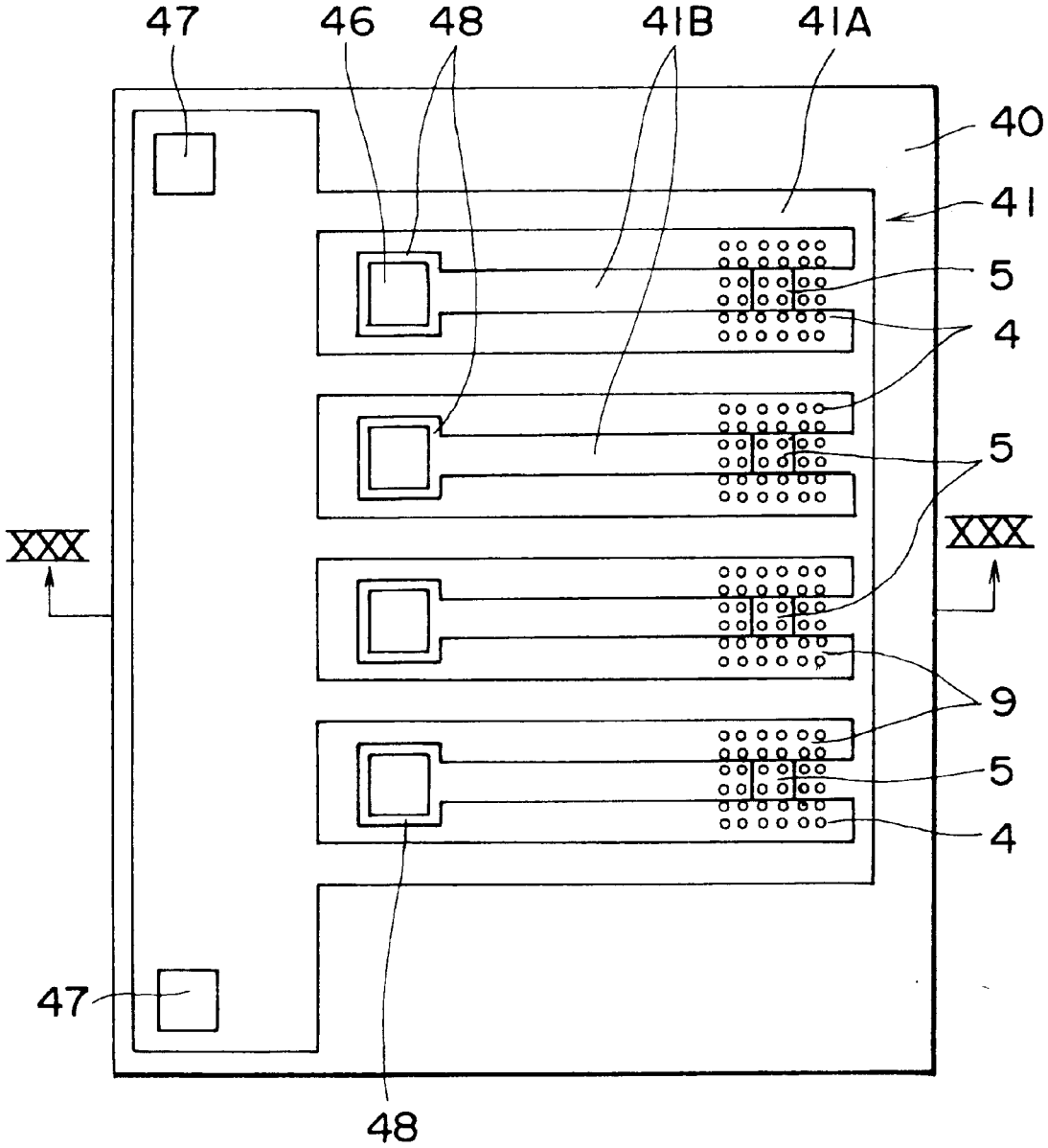

As shown in FIG. 30 (sectional view taken on line XXX—XXX of FIG. 37) and FIG. 37, the $SiO_2$ layer 44 is selectively etched using the chromium film formed in the specific pattern as a mask by RIE, to form dye storing portions 9 and a group of small pillars 4 (only four pieces are shown). A set of the dye storing portions 9 and the group of the small pillars 4 is formed for each of the heaters 5. At this time, the bonding pads 46 and 47 for leading electrodes are simultaneously opened, to expose the aluminum electrodes. In FIG. 37, the $SiO_2$ layer 44 shown in FIG. 30 is omitted, and a virtual line 50 in FIG. 30 designates a surrounding wall to be described later.

Figure 31:
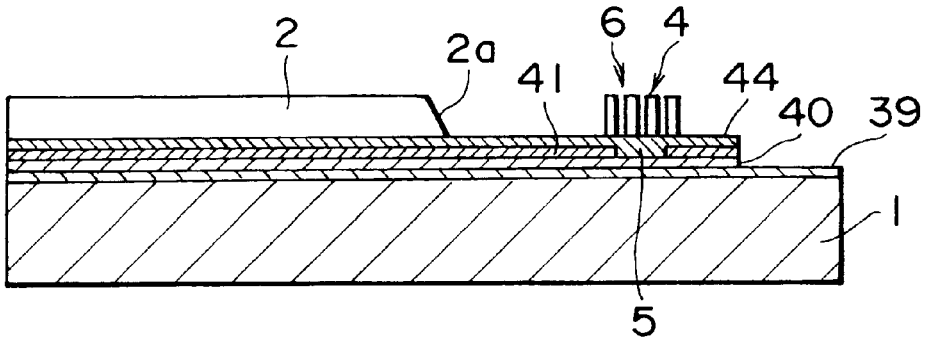
Figure 38:
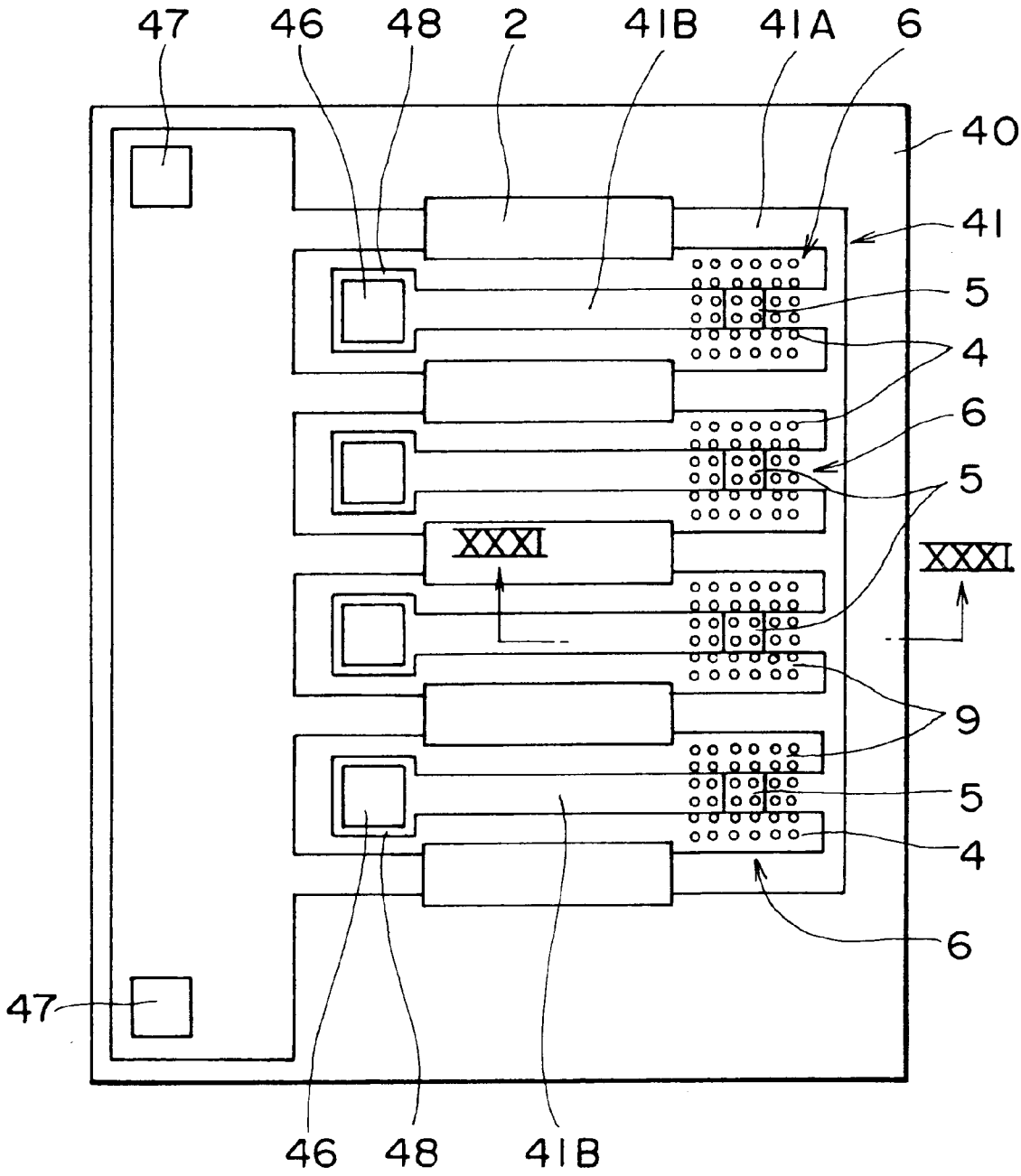

As shown in FIG. 31 (schematic sectional view taken on line XXXI—XXXI of FIG. 38) and FIG. 38, a dry film (sheet resist) having a thickness of about 25 $\mu$m is laminated, and is patterned into a specific pattern for forming partition walls 2 adapted to form dye supply passages.

The side wall 12 in the second, third and fourth embodiments may be formed by patterning like the partition walls 2 at this step. The extending partition walls 2A in the eighth embodiment, the partition walls 2B in the ninth embodiment, and the auxiliary walls 15 in the tenth embodiment may be formed by sticking at this step.

Figure 32:
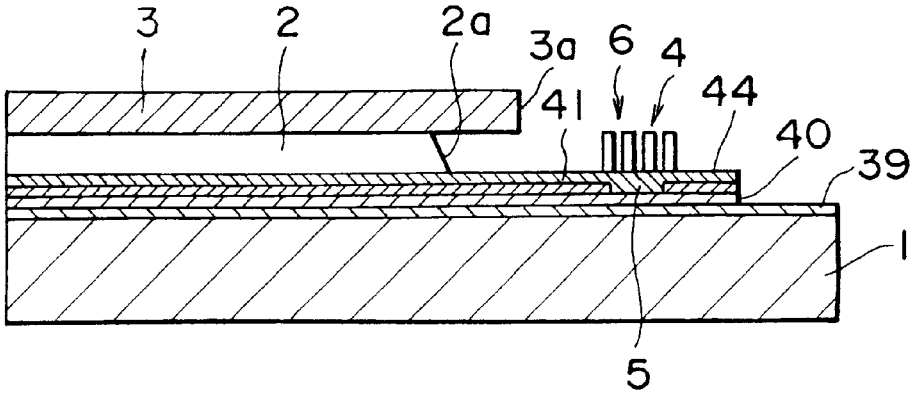
Figure 39:
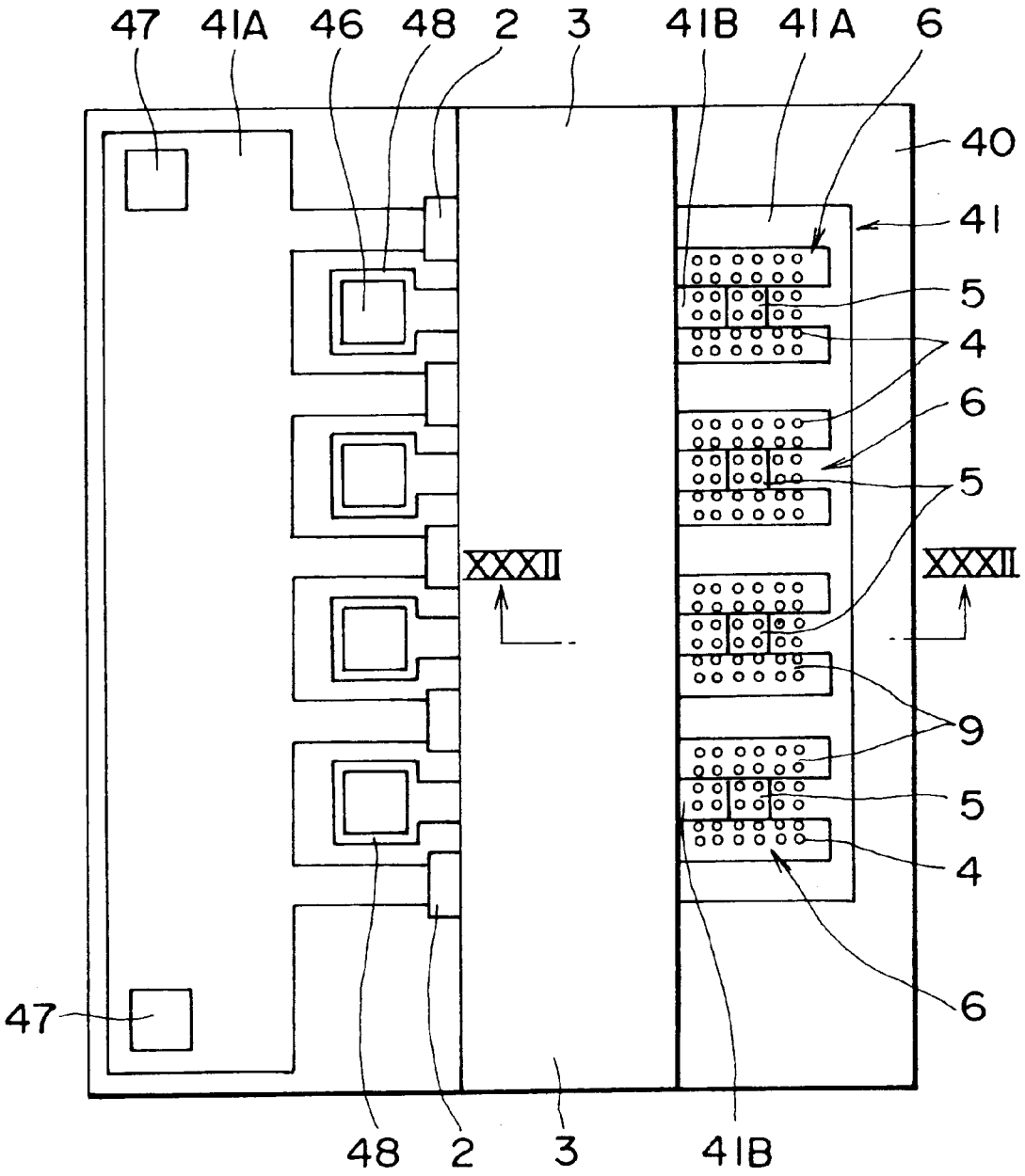

As shown in FIG. 32 (schematic sectional view taken on line XXXII—XXXII of FIG. 39) and FIG. 39, a lid 3 adapted to form ink supply passages, which lid is formed of a separately, accurately finished nickel film and has a thickness of about 25 $\mu$m, is formed by thermocompression bonding in such a manner that an edge 3*a* of the lid 3 projects from edges 2*a* of the partition walls 2.

The lid 13 provided on the side wall 12 in the second embodiment is mounted, at this step, on the side wall 12 after formation of the side wall 12. The lid in each of the third to seventh embodiments is formed thermocompression bonding in such a manner as to form orifices or a slit structure.

Dye supplying branched passages 8 are thus formed into tunnel shapes, each of which has a width equivalent to an interval between the heaters 5 and a height of about 25 $\mu$m. These branched passages 8 are adapted to supply the dye to the vaporizing portion by the capillary phenomenon in an amount necessary and sufficient for flying of the dye 7. Even for a dye supply passage in which any partition wall 2 is not provided, that is, any branched passage is not formed, the dye can be supplied in accordance with the capillary phenomenon by covering the base plate with the lid 3.

The silicon substrate 1, on which the heaters 5 of the vaporizing portion 6, wiring conductor, dye storing portions 9 and branched passages 8 are integrally formed, is then cut off into specific head chips. In this way, the head chip is accomplished.

Figure 42:
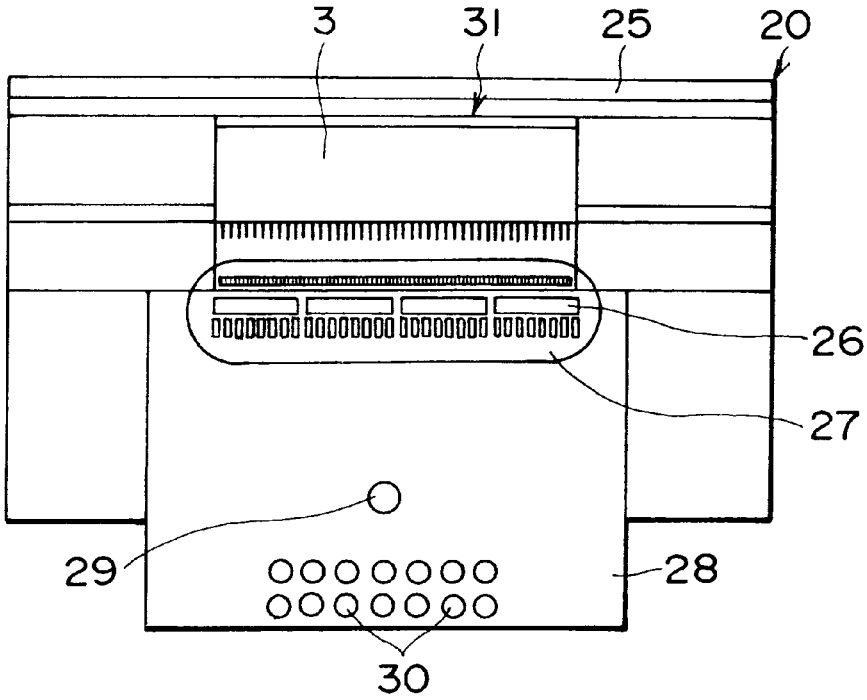
FIG. 42 is a plan view of a printer head proposed in the prior application, showing the state in which a cover is removed from the printer head.
Figure 43:
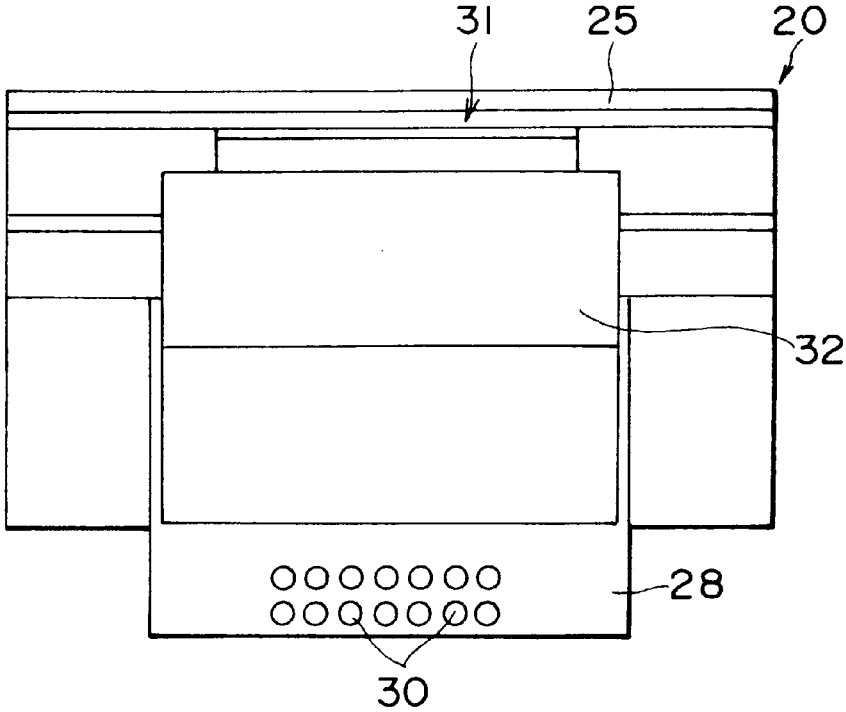
FIG. 43 is a plan view of the printer head proposed in the prior application in FIG. 42, showing the state in which the cover is mounted on the printer head.

A driver IC 26 is mounted, as shown in FIG. 42, for driving each heater 5 of the head chip in accordance with a signal corresponding image information, and copper wires are laid out on a printed board 28 made from a glass reinforced epoxy resin for connecting the driver IC 26 to a connector 30.

The copper wires between electrodes on the head chip and the driver IC 26 and between the driver IC 26 and the connector 30 on the printed board 28 are connected by wire-bonding using gold wires (diameter: 25 $\mu$m). To protect the wires bonded with the driver IC 26, the wire-bonded portions are coated with a silicone resin based JCR (junction coating resin), which resin is then thermally cured.

Figure 46:
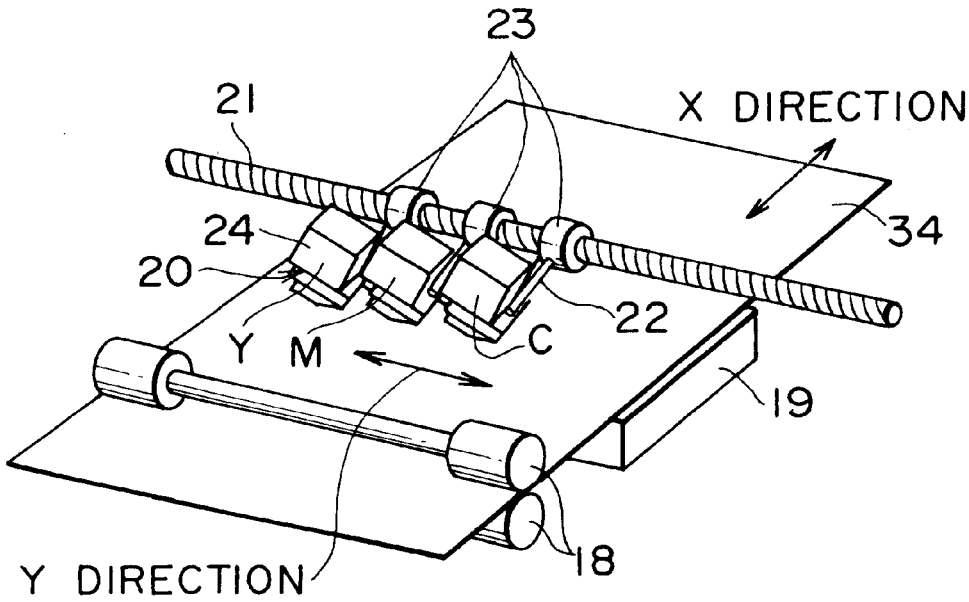
FIG. 46 is a schematic perspective view showing the state in which the printer head shown in FIG. 42 is operated in a serial mode.
Figure 47:
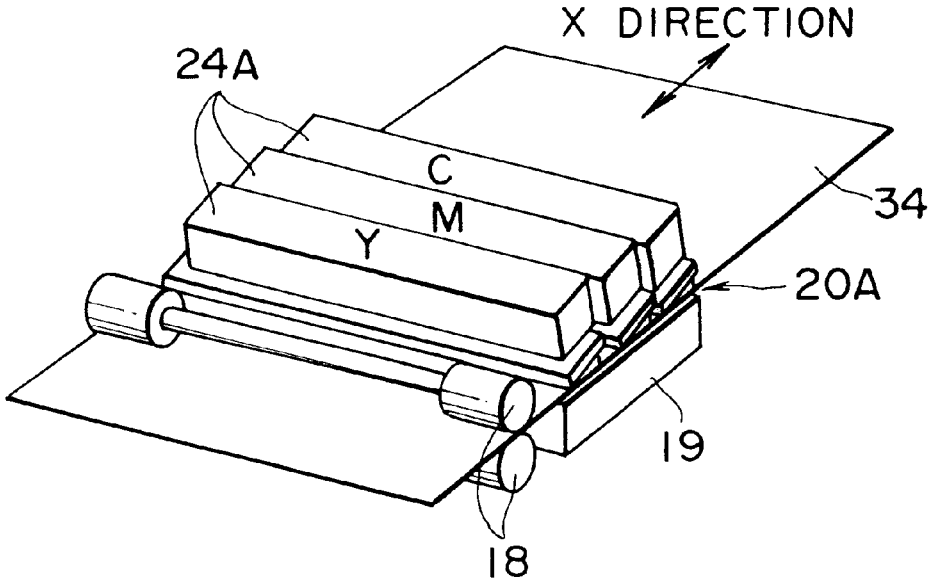
FIG. 47 is a schematic perspective view showing the state in which the printer head shown in FIG. 42 is operated in a line mode.

The head chip thus manufactured is, as shown in FIGS. 42 to 45, adhesively bonded on a base 25 which is then mounted with a cover 32, to form a printer head. The printer head is used in the serial mode shown in FIG. 46 or in the line mode shown in FIG. 47.

According to the manufacturing method in this embodiment, the head chip can be manufactured without significantly changing the manufacturing steps in the above-described inventions previously proposed by the present applicant, and without complicating the manufacturing steps.

Figure 40:
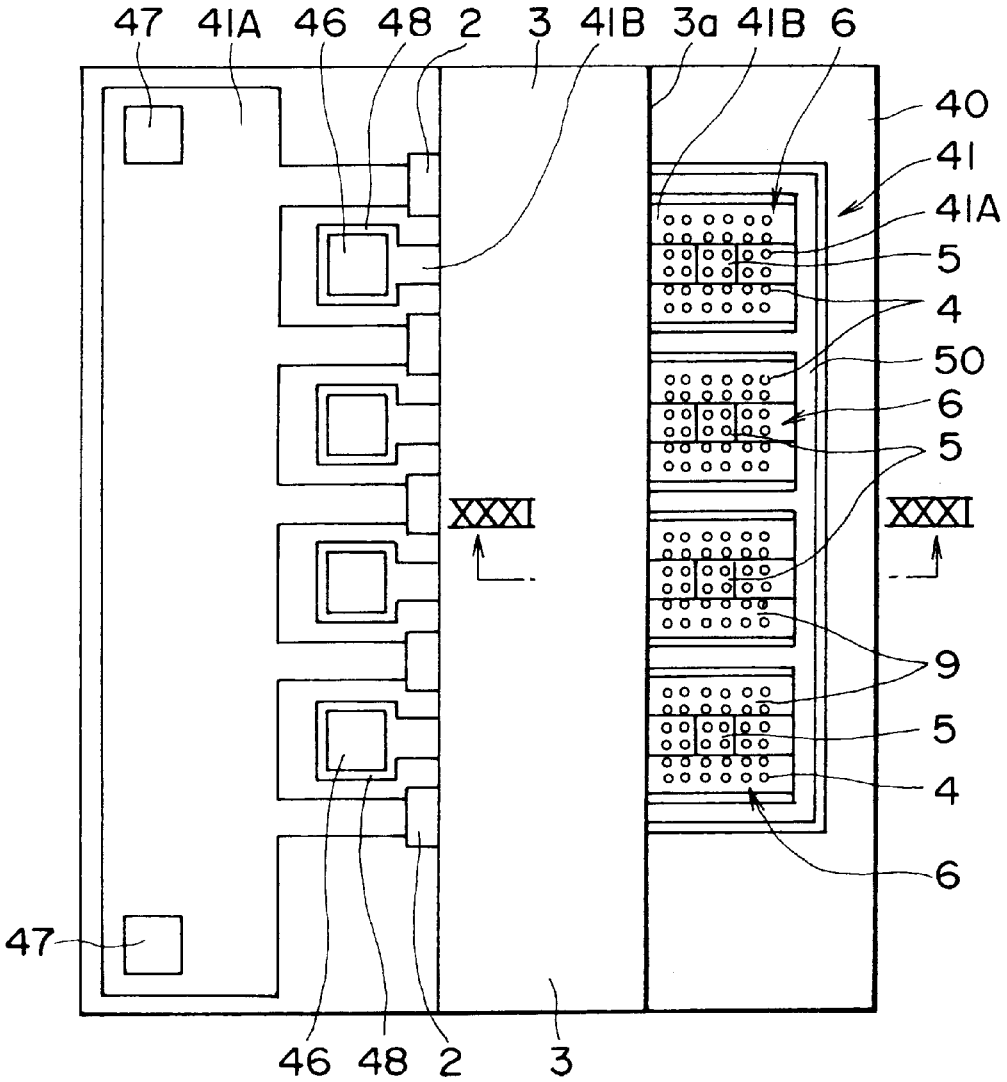
FIG. 40 is a schematic plan view showing part of a head chip according to a further embodiment.
Figure 41:
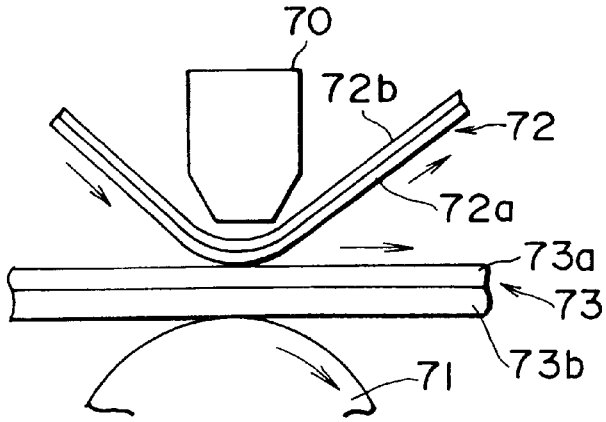
FIG. 41 is a schematic view showing an essential portion of a related art printer of a thermal transfer type.

Further, as shown in FIG. 40, like the previously proposed invention (Japanese Patent Laid-open No. Hei 7-354115), a second partition wall 50 made from $SiO_2$ (designated by the virtual line in FIG. 30) may be formed in such a manner as to surround the dye flying portions 6 and a lid 3 may be mounted in such a manner that an edge 3*a* of the lid 3 is positioned in the vicinity of the dye flying portions 6. With this configuration, it is possible to form a desired meniscus of the dye by the edge 3*a* of the lid 3 and the second partition wall 50.

While the embodiments of the present invention have been described in detail, it is to be understood that changes and variations may be made without departing the technical thought of the present invention.

For example, the structures, shapes and materials of the parts provided in the heater chip and recording head may be changed from those described in the above embodiments.

Upon recording, a body to be recorded may be moved or both a recording head and a body to be recorded may be relatively moved.

The shape, material, and size of the heater 5 may be variously changed or the heater 5 may be configured as combination of parts. The base plate 1 may be made from a ceramic material such as alumina, and the thermal characteristic of the head may be adjusted by combination of the heaters, heat insulators, and base plate.

The heights, planar or sectional shapes, density, and material of the small pillars 4 formed on the dye flying portion may be variously changed. For example, a photoresist having a pattern corresponding to pillars (in a negative/positive reversal relationship) is formed, and pillars are formed by electroplating a metal such as nickel using the photoresist as a mask. In this case, a conductive film is required to be previously formed as an undercoat.

As compared with the above-described method of forming pillars by etching the $SiO_2$ film, the method of forming pillars by electroplating makes it possible to omit time-consuming steps, such as formation of a $Sio_2$ film, formation of a metal mask, and etching of the $SiO_2$ film, and hence to form pillars for a short time, that is, improve the mass-productivity.

The structure of the dye flying portion may be configured as not only the above-described pillars but also wall bodies, an aggregate of beads, or fiber bodies.

The number of the dye storing portions, the number of dots, and the number of heaters or dye flying portions corresponding to the number of the dots may be variously changed. The arrangement shapes and sizes of the dye storing portions, heaters and dye flying portions are not limited to those described in the above embodiments.

In the embodiments, description is made by example of full color recording using recording dyes of three primaries, magenta, yellow and cyan (which may be further added with black); however, the present invention can be applied to two-color printing, one-color printing or black-and-white printing.

The heater may be made from a metal or a metal based material. The head base may be made from a material being high in thermal conductivity such as aluminum or a ceramic and the thermal characteristic of the recording head may be adjusted by the heaters, heat insulators, and head base material.

What is claimed is:

1. A recording apparatus comprising:

a base plate;

at least two partition walls forming a recording material supply passage on the base plate, each of the at least two partition walls having an edge;

a recording material flying portion located on the base plate, the recording material flying portion configured to receive a recording material from the recording material supply passage and to project the recording material on to a body; and a meniscus forming means for forming a meniscus of said recording material as said recording material flows from said recording material supply passage to said recording material flying portion, said meniscus forming means comprising a leading edge positioned in spaced apart relation from said recording material flying portion along said recording material supply passage;

wherein said meniscus of said recording material is formed at least between said edges of said at least two partition walls and said recording material flying portion.

2. The recording apparatus according to claim 1, wherein said at least two partitions walls are side walls of said recording material passage;

said meniscus forming means is a lid overlying said recording material flying portion; and said at least two partition walls and said lid form said recording material supply passage.

3. The recording apparatus according to claim 1, further comprising:

a second meniscus forming means for forming a meniscus of said recording material positioned across from said first meniscus forming means with said recording material flying portion positioned between said first and second meniscus forming means; and said second meniscus forming means forming a meniscus of said recording material between said recording material flying portion and said second meniscus forming means.

4. The recording apparatus of claim 1, wherein said leading edge defines an opening whose periphery surrounds said recording material flying portion in spaced apart relationship thereto.

5. The recording apparatus according to claim 1, wherein said meniscus forming means is formed between each edge of said at least two partition walls and said recording material flying portion.

6. The recording apparatus according to claim 2, wherein each of said at least two partition walls further comprise an extended portion having a first end and a second end, the first end of each extended portion being adjacent the respective edge of the partition wall and the second end of each extended portion projecting toward said recording material flying portion, each of said extended portions being provided as said meniscus forming means.

7. The recording apparatus according to claim 1, wherein said recording material flying portion has irregularities for holding said recording material.

8. The recording apparatus according to claim 1, wherein a plurality of branched passages, which are branched from a common recording material supply passage and adapted to supply said recording material to said recording material flying portion, are provided as said recording material supply passage between said at least two partition walls.

9. The recording apparatus according to claim 1, wherein the body to be recorded is disposed opposite to, and in non-contact with, said recording material flying portion and said recording material being heated to be flied to the body.

10. A method of manufacturing a recording apparatus having a recording material flying portion, configured to project, to a body to be recorded, a recording material, said method comprising the steps of:

providing a base plate;

forming a recording material supply passage between at least two partition walls on the base plate, each of the at least two partition walls having an edge;

separately finishing a meniscus forming area having a leading edge, positioning the leading edge in spaced apart relation from said recording material flying portion along said recording material supply passage; and forming a meniscus of said recording material at least between said edges of said at least two partition walls and said recording material flying portion.

11. The method of manufacturing a recording apparatus according to claim 10, wherein said step of separately finishing at least one meniscus forming area further includes mounting a lid, and said step of forming a recording material supply passage between said at least two partition walls further includes said lid.

12. The method of manufacturing a recording apparatus according to claim 10, the method further comprising the steps of:

separately finishing a second meniscus forming area and positioning said second meniscus forming area across from said first meniscus forming area with said recording material flying portion positioned between said first and second meniscus forming means; and forming a meniscus of said recording material between said recording material flying portion and said second meniscus forming area.

13. The method of manufacturing a recording apparatus according to claim 11, further comprising the said lid having an opening portion over said recording material flying portion.

14. The method of manufacturing a recording apparatus according to claim 10, further comprising the steps of mounting said meniscus forming area between said edges of said partition walls and said recording material flying portion.

15. The method of manufacturing a recording apparatus according to claim 10, further comprising the steps of:

providing an extended portion to each of said at least two partition walls, each extended portion having a first and a second end, the leading ends the first end being adjacent to the respective edge of said partition wall and the second end projecting toward said recording material flying portion; and providing each extended portion as said meniscus forming area.

16. The method of manufacturing a recording apparatus according to claim 10, further comprising the step of forming irregularities on said recording material flying portion for holding said recording material.

17. The method of manufacturing a recording apparatus according to claim 10, further comprising the step of providing a plurality of branched passages, which are branched from a common recording material supply passage and adapted to supply said recording material to said recording material flying portion, as said recording material supply passage between said at least two partition walls.

18. The method of manufacturing a recording apparatus according to claim 10, further comprising the step of heating said recording material to fly said recording material to the body to be recorded which is disposed opposite to said recording material flying portion in non-contact with said recording material flying portion.

* * * * *